US005556360A

United States Patent [19]

Kober et al.

[11] Patent Number: 5,556,360

[45] Date of Patent: Sep. 17, 1996

[54] HIGH PRODUCTION FOLDER CONSTRUCTION

[75] Inventors: Kasimir Kober, Niles; Martin T. Borucki, Chicago, both of Ill.

[73] Assignee: Chicago Dryer Company, Chicago, Ill.

[21] Appl. No.: 188,309

[22] Filed: Jan. 28, 1994

Related U.S. Application Data

[63] Continuation-in-part of Ser. No. 925,283, Aug. 4, 1992, Pat. No. 5,300,007, which is a continuation of Ser. No. 676,299, Mar. 27, 1991, abandoned.

[51] Int. Cl.[6] ..... B65H 45/04

[52] U.S. Cl. ..... 493/23; 493/418; 493/450

[58] Field of Search ..... 493/23, 25, 29, 493/418, 436, 450, 16, 20, 19, 27, 417

[56] References Cited

U.S. PATENT DOCUMENTS

| | | | |
|---|---|---|---|
| 2,545,798 | 3/1951 | Sjostrom | 270/84 |
| 2,754,113 | 7/1956 | Sjostrom | 270/84 |
| 2,941,797 | 6/1960 | Buss | 270/69 |
| 3,212,771 | 10/1965 | Kerman et al. | 270/59 |
| 3,252,700 | 5/1966 | Henry | 270/69 |
| 3,310,207 | 3/1967 | Gore | 223/39 |
| 3,502,322 | 3/1970 | Cran | 270/69 |
| 3,656,741 | 4/1972 | Macke et al. | 270/66 |
| 3,749,632 | 7/1973 | Gibbons | 156/364 |
| 4,059,257 | 11/1977 | Grantham | 270/66 |
| 4,060,227 | 11/1977 | Landgraf et al. | 270/66 |
| 4,093,205 | 6/1978 | Kober | 270/66 |
| 4,464,159 | 8/1984 | Grantham | 493/419 |
| 4,738,440 | 4/1988 | Weir | 270/45 |
| 4,998,910 | 3/1991 | Mohaupt et al. | 493/12 |
| 5,300,007 | 4/1994 | Kober | 493/23 |

FOREIGN PATENT DOCUMENTS

| | | |
|---|---|---|
| 3320381A1 | 12/1984 | Germany . |
| 1165730 | 10/1969 | United Kingdom . |

*Primary Examiner*—Jack W. Lavinder
*Attorney, Agent, or Firm*—Brinks Hofer Gilson & Lione

[57] ABSTRACT

A folder for laundry pieces such as towels is provided which employs opposed air discharges for forming precise French folds. The sequence and timing of air discharge through opposed air bars is precisely controlled to provide optimum speed and efficiency. When processing long laundry pieces the conveyor of such pieces is halted for minimum time periods necessary to complete the desired folding sequence.

22 Claims, 14 Drawing Sheets

FIG. 2
PRIOR ART
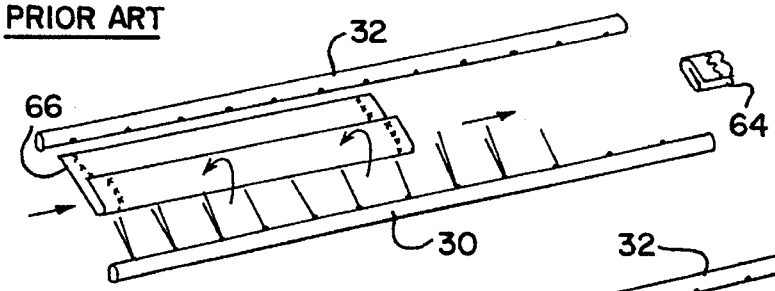
FIG. 2A
PRIOR ART
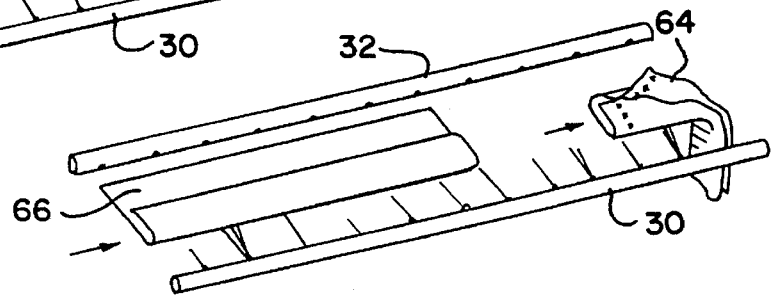
FIG. 3
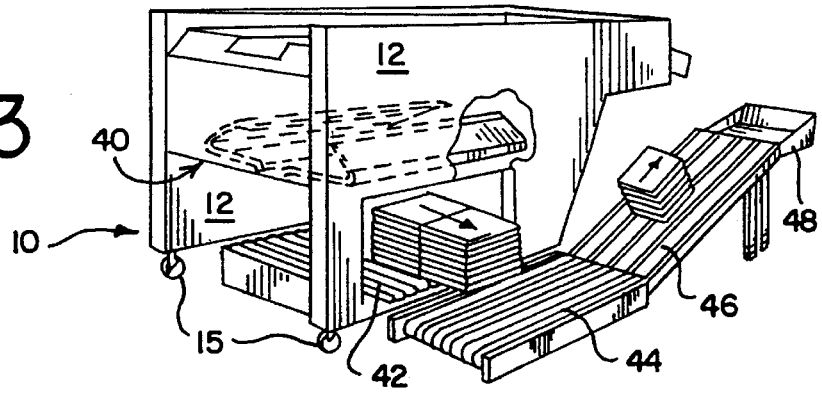
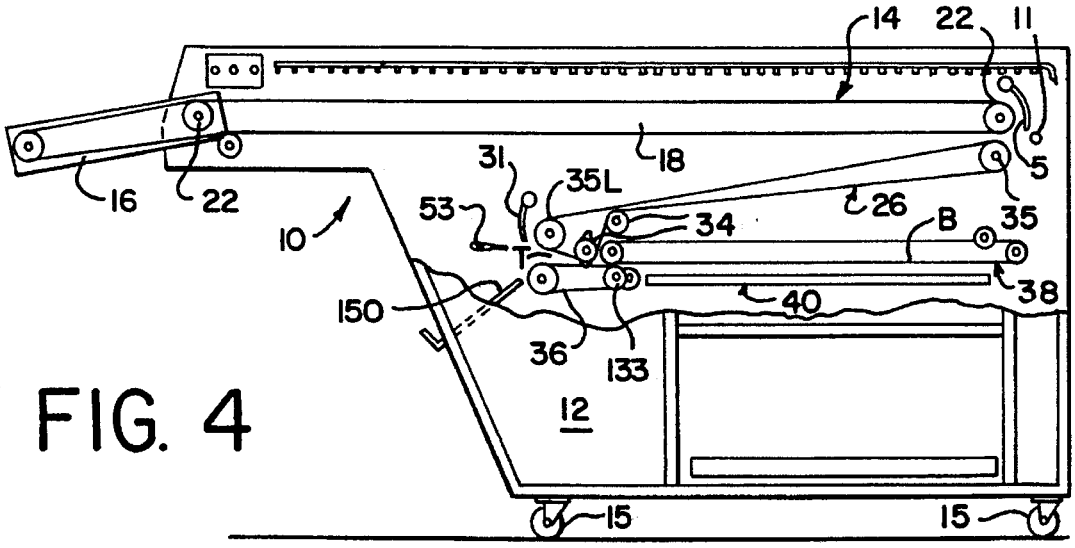
FIG. 4

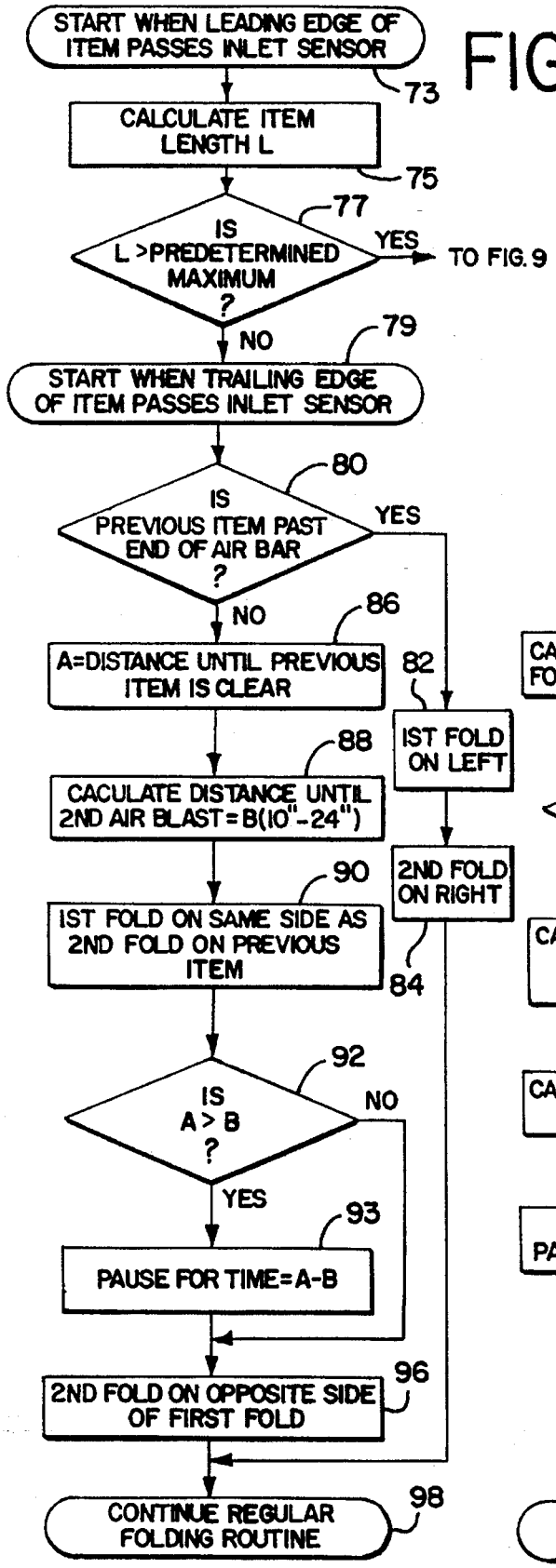
FIG. 8
FIG. 9
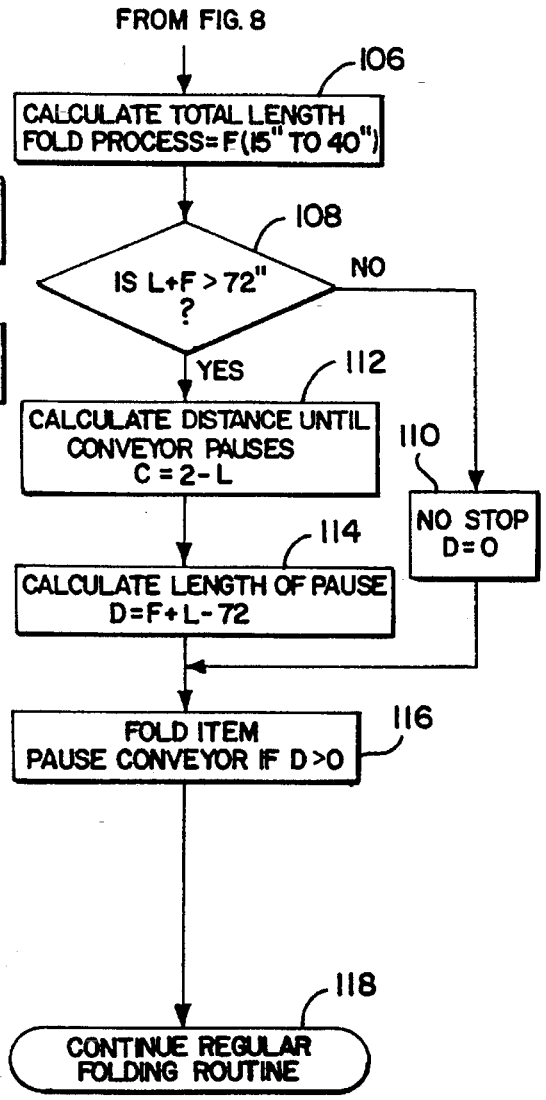

HIGH PRODUCTION FOLDER CONSTRUCTION

This is a continuation-in-part of U.S. Ser. No. 07/925,283 filed Aug. 4, 1992 (now U.S. Pat. No. 5,300,007) which is a continuation of U.S. Ser. No. 07/676,299 filed Mar. 27, 1991 now abandoned. The disclosure of such parent applications is incorporated herein by reference.

BACKGROUND OF THE INVENTION

1. Field of this Invention

This invention relates to a high-production folder adapted to form French folds in foldable laundry items by means of air discharge. More particularly, a laundry folder is provided with controlled air discharge and conveyor movement which increase the speed and efficiency of the folding operations carried out.

2. Description of the Related Art

The prior art discloses the use of opposed air blasts in forming folds in sheet material, as in Cran U.S. Pat. No. 3,502,322. However, this patent does not suggest the air discharge control resulting in optimum speed and efficiency present in the apparatus of this application.

Landgraf et al. U.S. Pat. No. 4,060,227 discloses opposed air discharge tubes which form French folds in small laundry pieces. This patent does not suggest, however, the folding control and flexibility of folding operation present in the apparatus of this application.

Sherrill U.S. Pat. No. 3,423,083 discloses the use of opposed alternating air discharges for forming folds in a continuous length of fabric with the assistance of hold-down bars. However, there is no suggestion of the high speed folder of laundry items of the type hereinafter disclosed.

Sjostrom U.S. Pat. No. 2,754,113 discloses a sheet folding machine which may employ reciprocating plates or air pipes for forming longitudinal folds in sequence in sheet material. This patent does not suggest the high speed efficiency possible with coordinated air discharges and the conveyor movement of this invention.

The folder of this invention employs oppositely disposed air bars which discharge air in sequence for folding opposed panel portions of conveyed articles, and, in particular, towels, into a French fold. The air bars are responsive to an article measuring device and controller which regulate the air discharge sequence and the panel folding sequence. As a result, closely spaced articles such as towels may be folded without danger of an air discharge tending to unfold an adjacent, already folded towel. The folder also provides hesitation of the folding air discharges as well as conveyor hesitation for minimum time periods in effecting maximum production as will hereinafter be explained in greater detail.

It is thus an object of this invention to provide a high speed folder for foldable laundry articles, particularly towels, which employs oppositely disposed, sequentially operable air discharge means whereby conveyed articles are efficiently folded in closely spaced relationship.

It is another object of this invention to provide a laundry folder and process for forming French folds in which the particular sequence of air discharge by opposed air bars is responsive to an article measuring means in conjunction with a controller while the articles folded are conveyed by a folder conveyor.

It is a further object of this invention to provide a folder for laundry articles which is able to effect French folding of large foldable articles in the stationary position in a minimum amount of time. The minimum folder conveyor stoppage enables the folder to attain desired maximum production.

It is an object of this invention to provide a folder for foldable sheet material which is of high capacity although of a size which occupies a minimum of normally valuable laundry working area.

The above and other objects of this invention will become apparent from the following description when read in the light of the accompanying drawing and appended claims.

SUMMARY OF THE INVENTION

In one embodiment of the provided invention a conveyor of continuous ribbons conveys a towel or other laundry article to be French folded under spaced parallel runners. Opposed article side panels of the conveyed article are conveyed by ribbons which slide over support plates. Article detectors such as photo sensors detect the length of the articles folded with the assistance of an electronic generator-counter which generates counts or pulses for as long as the article is sensed. The pulses are stored in a programmable controller. Opposed air bars disposed beneath the article side panels discharge air in sequence in a "folding field" for sequentially urging the article side panels into an overlapping relation, and over the runners and an article center panel between the side panels to form a French fold.

The air discharges of the provided apparatus are controlled by the controller which receives the information provided by the sensor or sensors conveying article size information. As a result air discharges may effect two folds on a foldable article while moving in the folding field disposed over the moving conveyor, before the foldable article such as a towel passes from the folding field or beyond the air bar terminal ends. In accordance with this invention the speed and resulting production of the provided folder are increased by alternating the air discharge sequence of the opposed air bars. As a consequence the first fold of an adjacent second folded article on a moving conveyor moving between the air bars is carried out by the same air bar which effected the second fold of a first-folded article, just leaving the folding field between the air bars. Such air discharge serves to further compress the second fold of the first-folded article rather than tending to effect an unfurling action.

If the article folded is so large that the second fold cannot be effected prior to such article exiting the folding field, the controller of the air discharges will stop the conveyor to enable the second fold to be completed between the air bars with the conveyor in stopped condition for a minimum time period. Immediately following the second fold and the completion of the French fold the conveyor is activated so that the folded article may proceed through the folder for additional desired processing.

BRIEF DESCRIPTION OF THE DRAWINGS

FIGS. 2 and 2A are fragmentary perspective views illustrative of folds made by prior art devices on foldable articles, such as towels.

FIG. 3 is a perspective view of a folder partially broken away and illustrating a trap door of a stacker and associated conveyors adapted to move stacks of folded articles to the feed end of a folder which may incorporate the invention of this application.

FIG. 4 is a schematic side elevation end view of a folder which may incorporate the invention of this application and illustrating the various conveyor levels therein.

FIG. 8 is a flow chart illustrating the various steps of the controller program of the apparatus of this invention in providing increased production in the folding of smaller foldable articles.

FIG. 9 is a flow chart illustrating the various steps of the controller program of the apparatus of this invention for purposes of folding larger foldable articles, including conveyor stops for minimum time intervals.

DESCRIPTION OF THE PREFERRED EMBODIMENTS

Figure 5:
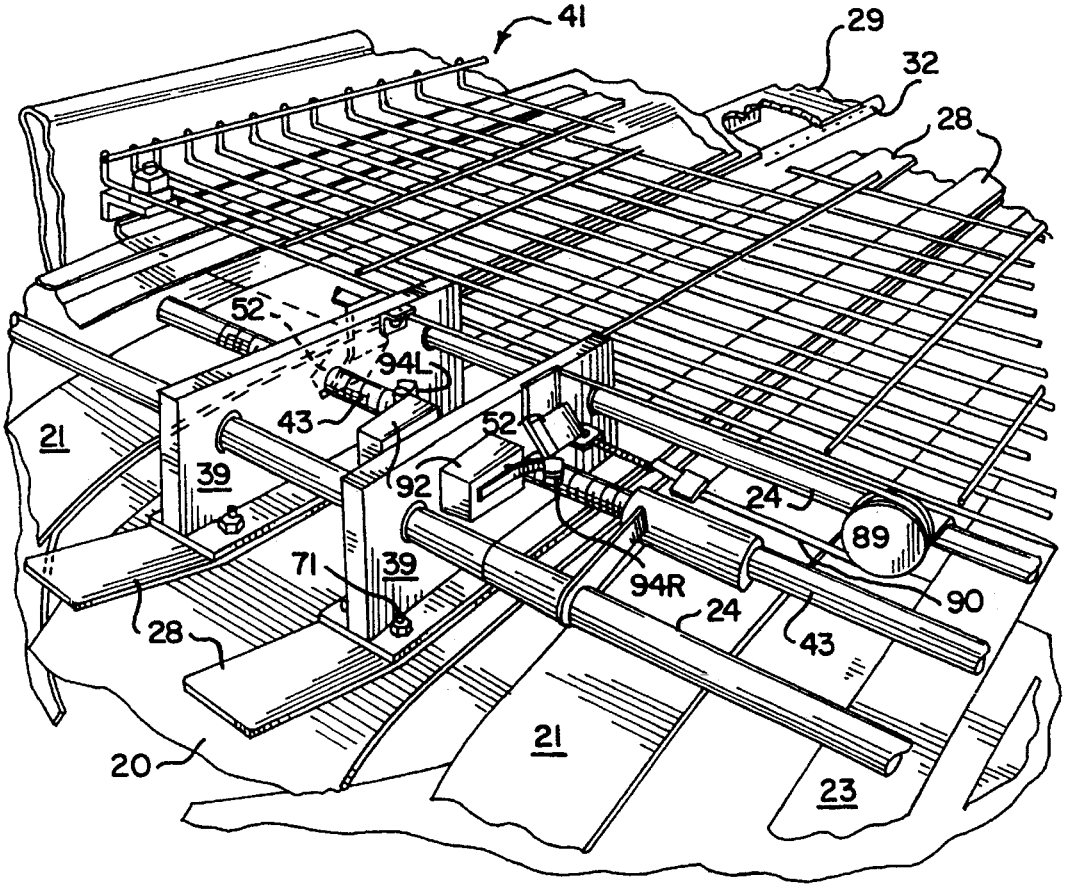
FIG. 5 is a fragmentary perspective view of the feed end of a folder which may incorporate the invention of this application and illustrating fold forming runners and associated apparatus for forming the interval therebetween.
Figure 6:
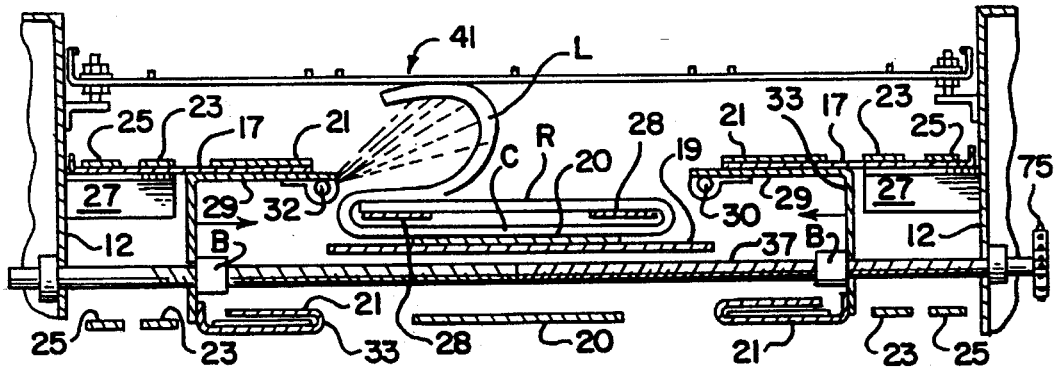
FIG. 6 is a sectional view illustrating a second fold in the process of being made by a second sequential air blast in the course of forming a French fold in a towel, the larger radius of the left panel L in the course of folding being evident.

A folding apparatus which may incorporate the invention of this application comprises apparatus disclosed in copending application U.S. Ser. No. 07/925,283 filed Aug. 4, 1992, now U.S. Pat. No. 5,300,007. Such a folder 10 (FIG. 3) comprises opposed side walls 12 mounted on casters 15 for ease of positioning within a laundry area. The apparatus 10 employs an upper conveyor 14 (FIG. 4) having a substantially horizontal conveyor portion 18 and an inclined feed conveyor portion 16. Other structural features of the folder 10 are seen in FIGS. 5 and 6 of the drawing.

In the normal course of folder use, a foldable article, such as a towel, is centered on feed conveyor portion 16 of FIG. 4, whereafter the article is conveyed onto the horizontal conveyor portion 18. These conveyor portions comprise a center continuous ribbon or belt 20, more clearly seen in FIGS. 5 and 6. The upper run of ribbon 20 slidable moved over a smooth support plate 19 as illustrated in FIG. 6. Disposed on either side of center ribbon 20 is a series of three ribbons, 21, 23 and 25, which upon entering the horizontal conveyor portion 18 of the apparatus are elevated relative to center ribbon 20 by means of support plates 17 fixedly mounted on support brackets 27 supported on sidewalls 12 as illustrated in FIG. 6. Opposed air bars 30 and 32 are mounted on the underside of opposed movable plates 29. The plates 29 slidably engage the undersurfaces of the fixed plates 17 and are supportively mounted on threaded justing rods 37 having threads of opposite hand as illustrated in FIG. 6, one of such rods 37 being shown in the latter figure. The interval between the plates 29 and the opposed air bars 30 and 32 may be regulated by means of a reversible adjusting motor (not illustrated) referred to in the block diagram of FIG. 10 as the "width drive motor 60". The latter motor drives a sprocket, such as sprocket 75 attached to the end of the threaded rod 37 engaging threaded bearings B on plates 29 seen in FIG. 6.

Disposed between the opposed air bars 30 and 32 and overlying the center conveyor ribbon 20 of the conveyor 14 are spaced runners 28. The outermost edges of these runners serve as the folding axes about which the opposed panel portions of the foldable articles are folded by discharges from the opposed air bars 30 and 32 in the manner indicated in FIG. 6. The runners are secured to the bottom edges of mounting blocks 39 (FIG. 5) which threadably engage a threaded adjusting rod 43 having threads of opposite hand. Such threads engage threaded bearings openings in the mounting blocks 39. Accordingly, rotation of the rod 43 and guiding action of blocks 39 provided by guide rods 24 will effect a desired interval between the blocks as well as the secured runners 28. The width adjusting motor simultaneously adjusts the interval between the air bars 30 and 32 and the interval between the runners 28.

In the normal course of apparatus operation, the folder operator will segregate the foldable articles to be folded and processed into batches of similar size. Upon noting the width of the articles to be folded the operator will select an appropriate interval between the runners 28 by a control setting which actuates the width drive motor. Stop means for the reversible adjusting motor 60 may comprise a simple servo mechanism, including rotatable potentiometer 89 and a belt 90 illustrated in FIG. 5 which stop the motor when the potentiometer voltage of the operator's width setting is reached. FIG. 5 also illustrates limit switches 92 having arms 94L and 94R which, in conjunction with adjacent stop surfaces, determine the maximum permissible movement of the runners 28. Equivalent means for setting the intervals between the runners 28 and known to the art may be employed.

A feature of the preferred embodiment of folder 10 which was fully discussed in copending U.S. application Ser. No. 07/925,283 is the stop surface 41 illustrated in FIGS. 5 and 6 and comprising a surface against which the panel portions of a foldable article are guided and slidably ride in the course of effecting a rolling fold in the manner illustrated in FIG. 6. Such stop surface enables a panel portion being folded to roll into a final position with a precise edge alignment providing an attractive final appearance. FIG. 5 further illustrates spaced optical sensors 52 mounted on spaced mounting blocks 39. Two sensors may be utilized if small-width articles are employed which require a single runner 28 for forming half folds as discussed in detail in the copending application.

The foregoing features pertaining to the upper conveyor 14 were disclosed in the copending application and comprise no inventive aspect of this application.

The invention of this application is directed to a folder and methods for effecting French folds in a rapid manner in foldable articles such as towels on upper conveyor 14 of the folder 10. Referring to FIG. 2 of drawing, adjacent foldable articles 66 and 64 schematically illustrated indicate the manner in which the opposed air bars 30 and 32 of the prior art consistently maintained the same sequence of air discharge during folding operations. Means for defining folding axes, such as runners, and other conveyor details are not illustrated in FIG. 1 through FIG. 2A to facilitate an explanation of the invention of this application. Thus, it will be noted that in the completely folded article 64 of FIG. 2 the first-folded inner panel was folded by discharge from air bar 30 whereafter the opposed outer panel was folded by air bar 32. The sequence would thus consistently be air discharge by bar 30 followed by discharge by air bar 32.

If a first air discharge by air bar 30 were to be applied to a sheet or towel 66 as in FIG. 2A while the already French folded article 64 remained in the folding field between the opposed air bars 30 and 32, the new air blast from the air bar 30 in the course of forming the initial fold in article 66 would unfurl the French folded article 64, as illustrated.

To avoid this problem, the prior art did not effect a first fold on a second article 66 as in FIG. 2 until the previously folded article, such as article 64, had left the folding field, that is, no longer remained between the air discharge bars 30 and 32 as illustrated. It is apparent, therefore, that to avoid the unfurling illustrated in FIG. 2A, the interval between the trailing edge of an already folded article, such as article 64 of FIG. 2A, and the trailing edge of a subsequent foldable article, such as article 66 of FIG. 2A, was at least the length of the air bars 30 and 32 as illustrated in FIG. 2.

In accordance with this invention, the interval between successive foldable items, such as towels to be French folded, need not be the length of the air bars or folding field as necessitated by the prior art utilization of opposed air bars functioning in a consistent sequence. Thus, it will be noted in FIG. 1C of the drawing that after foldable article 70 is conveyed entirely within the folding field between the opposed air bars, air bar 30 immediately emits air forming the first fold as illustrated. Such first fold will not disturb the already French folded prior article 72 as the first fold imparted to the article 70 is for the panel R as illustrated, although air bar 30 imparted the second fold to the prior foldable article 72.

Figure 1:
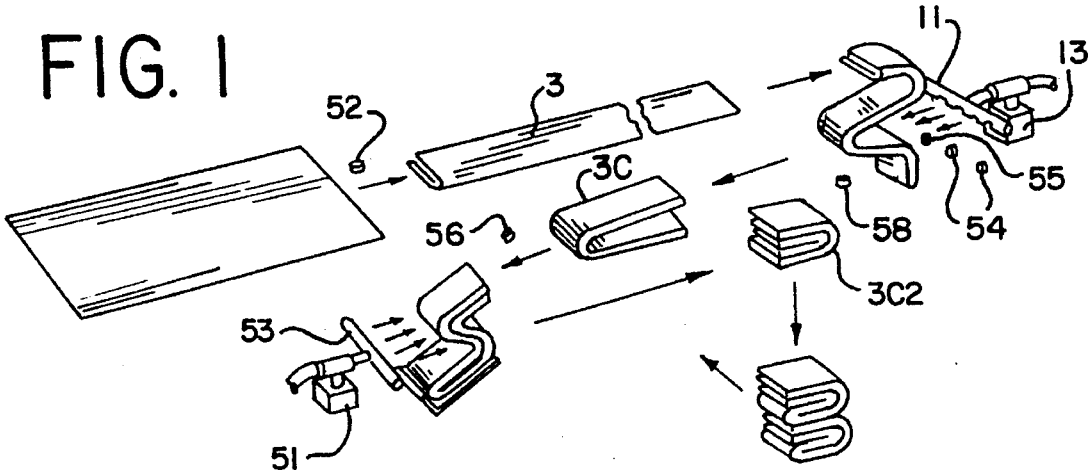
FIG. 1 is a schematic perspective view illustrating folds which may be made utilizing the folder of this invention.
Figure 1A:
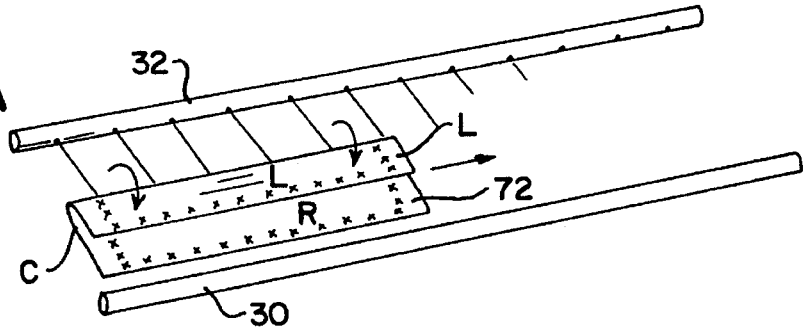
FIGS. 1A to IF are schematic perspective views illustrating the folds made possible on the conveyor portion of the provided apparatus of this invention by the novel air discharge control.
Figure 1B:
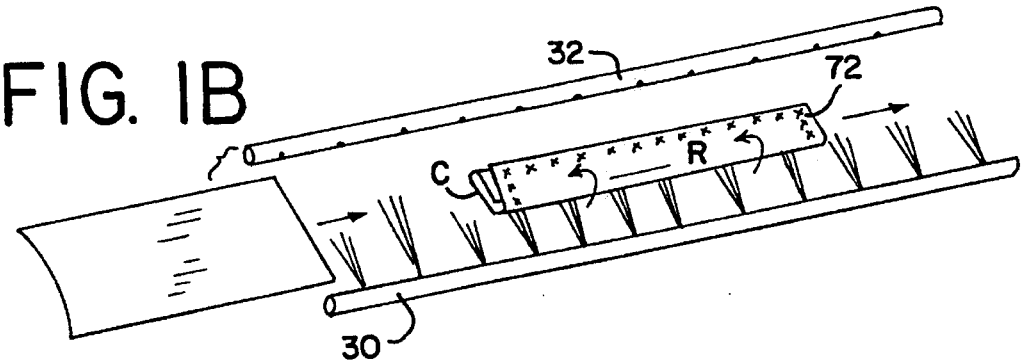
FIG. 1F also discloses a series of folds which may be made as a French folded article proceeds through the apparatus.

Referring to FIGS. 1A and 1B, it will be seen that when folding article 72, air bar 32 first folded the left panel L of such article over bottom center panel C, and as article 72 continuously moved on the upper conveyor 14 of the apparatus 10, air bar 30 subsequently folded the right hand panel R of the article 72.

Figure 1C:
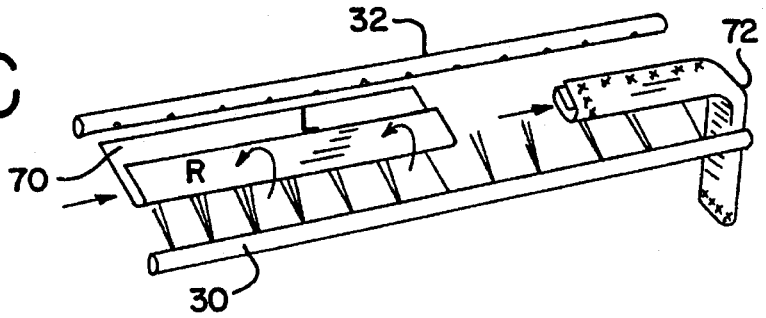

In accordance with this invention, therefore, a second foldable article, such as article 70 of FIG. 1C, may be folded while a prior folded article, such as article 72 of FIG. 1C, remains within the folding field between the air bars 30 and 32. This relationship is permissible if the first air blast or discharge imparted to the second trailing foldable article is from the same side as the second fold of the prior article, such as article 72 in FIG. 1C.

Figure 1D:
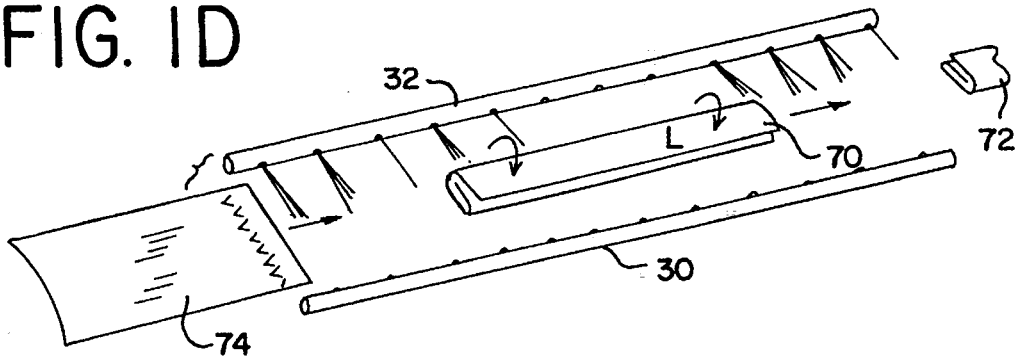

To prevent fold unfurling evident in FIG. 2A of the drawing, the second fold on the trailing article 70 of FIG. 1C cannot be effected until the prior article 72 is removed from the folding field and is no longer between the air bars 30 and 32 as seen in FIG. 1D.

Figure 1E:
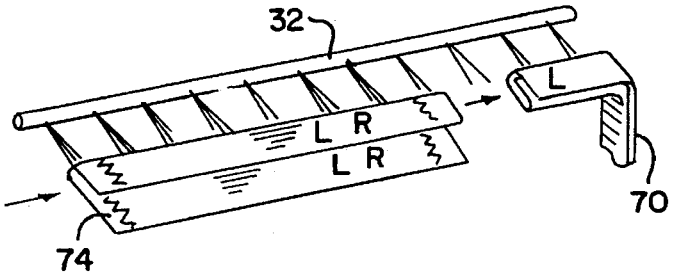

FIG. 1E shows the continuation of the folding process of this application on a foldable article, such as towel 74, which trails the now French folded article 70. The first fold of the left panel L of towel 74 is carried out by air bar 32 which, as noted from FIG. 1D, was the air bar which effected the second fold comprising the left panel L in the foldable article 70. As in FIG. 1C, the previously folded article 70 may remain within the folding field during the formation of the first fold on the trailing article 74.

The benefits of the provided alternating sequence of air bar discharges are apparent. In the prior art devices the fixed sequence of alternating air bar operation necessitated a minimum conveyor interval between foldable articles equal to the length of the folding field. Utilizing folders of the type disclosed in this application, the field is approximately 72 inches long, the length of a "pool" towel, the longest towel normally encountered by a laundry in its folding operations. Assuming a conveyor speed of approximately 160 feet per minute, or 32 inches per second, as the conveyor speed, the ability of the folder herein disclosed to automatically select the sequence of air bar discharge and enable a trailing piece to be folded while a prior piece remains within the folding field increases the article processing rate to as many as 40 per minute, as will be noted hereinafter. The prior art maximum processing rate at the same conveyor speed was 24 items per minute employing the same 72-inch folding field. Such increased production is an obvious benefit to a laundry operator.

Folder operators, particularly those paid on a piece basis, endeavor to feed foldable articles into a folding device as rapidly as possible. Accordingly, the interval between the foldable articles which are fed as onto upper conveyor 14 of the folder 10 of this application will vary from a minimum of about 10 inches between the trailing edge of a first-fed article and the leading edge of a trailing article. This is the approximate minimum interval which will be present when smaller foldable articles are fed by an experienced operator at a 32 inch per second conveyor speed. The interval, however, between pool size towels which are approximately 36 inches wide by 72 inches in length will be at least about 12 inches in view of the manipulation necessary in order to properly feed the larger towels. Accordingly, in the case of small towels it is common for two towels to simultaneously be in the folding field. Thus, it is possible that the interval therebetween is such that the second air discharge as, for instance, that emitted by air bar 32 in FIG. 1C for purposes of folding the left panel L into overlying relationship with the already folded right panel R, is ready to be effected while the previous article, such as article 72, remains within the folding field. It is thus necessary to delay the air discharge from air bar 32 until the article 72 has left the folding field.

If the first fold of a foldable article takes place in the folding field between the air bars after a previously folded article has left the folding field, as, for instance, in FIG. 1A, there is, of course, no need to alter the sequence of air discharge from the opposed air bars 30, 32. Thus, in FIG. 1A the first air discharge is from air bar 32 folding the left panel L. Bar 32 may also have imparted the first air discharge in a previously folded article no longer in the folding field. Accordingly, if the interval between the articles is at least the length of the folding field, there is no need to alter the sequence of air discharges form the air bars and the air bars may consistently function in a sequence such as 32–30, 32–30. A large interval equal to or greater than the folding field, i.e., the length of the air bars, may exist in a series of articles. A slow feed rate may occur if the operator feeding the articles onto the upper conveyor of the apparatus 10 is inexperienced, or for some reason the rate of towel production is of minor importance and the operator feeds the articles at a leisurely pace.

As explained in the parent application, Ser. No. 07/925,283, now U.S. Pat. No. 5,300,007, the folding operations carried out in the apparatus 10 are controlled by means of a programmable logic controller 50. The hardware for the programmable logic controller 50 is illustrated in FIGS. 14–20. The flow diagrams for the controller 50 are illustrated in FIGS. 8 and 9, while the source code for the controller 50 is included as Appendix 1.

The controller 50 controls the various folding operations by providing signals to the coils of various solenoid valves, such as French fold air valve coils 97 and 99, to control the air discharge through the air bars 30 and 32 as a function of the length of the foldable article and the location of the foldable article relative to the folding field at a given point in time. The length of each foldable article, as well as the precise location of each foldable article fed onto the upper conveyor 14, is determined by the controller 50 by way of one or more optical sensors 52 (FIGS. 1 and 5) which measure the length of each foldable article, determined by the programmer 50 with the assistance of an electronic generator-counter device which generates counts or pulses for as long as the foldable article is sensed by the sensor 52 in a manner well known in the art, as discussed below. The optical sensors 52 may be of a known type, such as the optical sensors sold under the tradename Micro-Switch Model FE7B. In particular, the length of a foldable article is determined by counting pulses from the time the leading edge of a foldable article is sensed by the inlet sensors 52 until such time that the foldable article is no longer sensed as indicated in steps 73 and 75 (FIG. 8). Since the speed of the conveyor is known, the length of the foldable article will be a function of the number of pulses counted during the time interval in which the inlet optical sensor 52 senses the article. If the length of the foldable article is less than a predetermined value, for example 48 inches, as determined in step 77, system control proceeds according to the flow diagram illustrated in FIG. 8. If the length of the foldable article is greater than a predetermined number, such as 48 inches, as determined in step 77, system control is passed to the flow diagram illustrated in FIG. 9, discussed below.

Presuming the item is less than 48 inches, the controller 50 calculates the location of a prior folded article (if any) relative to the folding field and makes a determination as to whether such prior article is beyond the end of the air bars and out of the folding field. In particular, since there will be gaps between articles to be folded, pulses are counted from the time the inlet optical sensors 52 no longer senses the prior article, as illustrated in step 79. Since the speed of the conveyor is fixed, the number of pulses counted during the time interval during which no article is being sensed by the inlet optical sensor 52 will provide an indication of the distance that a previously folded article has traveled. By subtracting the length of the folding field from the distance calculated during the time internal in which no foldable article is sensed, the system is able to determine the position of the previously folded article relative to the folding field at any given time as indicated by step 80.

Assuming an article, such as article 72, is currently within the folding field and no previously folded article is within the folding field, indicating no obstacle to folding by the opposed air bars 30 and 32, the controller 50 effects the French fold as illustrated in FIGS. 1A and 1B with the left panel being first folded by the air bar 32 and the right panel being folded by the air bar 30. In particular, when there is no prior foldable article in the folding field, as determined in step 80, any article entering the folding field by itself is folded in the sequence of FIGS. 1A and 1B, as indicated in steps 82 and 84.

If the trailing edge of a prior article has not left the folding field before a subsequent article is sensed by the optical sensors 52, as indicated in step 80, the controller 50 calculates the distance (A) until the previous article is clear of the folding field as indicated in step 86 (FIG. 8) in a similar manner as discussed above. Such a situation is depicted in FIG. 1C of the drawing. The controller 50 also calculates the distance (B) which the partially folded article 70 must travel until the time for the second air discharge or the folding of the panel L must take place in step 88. That is, the controller 50 calculates the travel of the article 70 for the folding of the right panel R despite article 72 remaining within the folding field. The distance until the second air blast is calculated by determining when an article of length L has traveled a distance equal to the length of the first air blast plus a small time interval discussed below. More particularly, as indicated above, the length L of the article is determined in step 75. Once the length of the article is known, the distance B that the article must travel until being subjected to the second air blast is determined by calculating the distance traveled during the time period of the first air blast and adding a predetermined time interval discussed below.

As stated above, the controller 50 prevents the folding of the panel L while the article 72 remains within the folding field to prevent the unfurling of the folded article 72 should air bar 32 be activated. Accordingly, in step 90, the controller 50 will activate the air bar 30 to effect a first fold of the right panel R of article 70 on the same side as the second fold effected on the previously folded article 72 as illustrated in FIG. 1C.

If the controller 50 calculates that the distance (A) which must be traveled by the previous article 72 to clear the folding field is greater than the distance (B) which the leading edge of the trailing article 70 must traverse in the folding field until the second fold is carried out, the second activated air bar 32 of FIG. 1C must pause to allow the first folded article 72 to exit the folding field. Once the folding field is clear of article 72, the air bar 32 is actuated to effect the second fold illustrated in FIG. 1D.

If it is determined in step 92 that the distance (B) to be traversed by the article 70 until the second fold is to take place is greater than the distance (A) to be traversed by the article 72 in leaving the folding field, the condition of FIG. 2A of the drawing will not be encountered and no pause in the emission of air from the second air bar 32 of FIG. 1D will be necessary. In this situation, the second fold is effected on the opposite side as the first fold without pause as indicated in step 96.

When it is determined in step 92 that a pause in the discharge of air from the second air bar is necessary, the pause is determined in step 93 for the minimum time interval (A-B) which terminates as the first-folded article exits the folding field. After the pause, the second fold is made, as indicated in step 96. Subsequently, the foldable article continues in the course of its regular folding procedure in the apparatus 10 for processing by the various conveyors, stacking and discharge mechanisms as denoted in step 98 and discussed below.

As noted above, once the length L of an article is sensed by the controller 50, the distance of travel on the conveyor 14 until the time of the second air blast is calculated. This time includes time that a foldable article travels in the folding field to fold the first folded side panel R or L, plus a fraction of a second interval which the apparatus employs between the two air blasts for folding the two article panels. For example, the apparatus 10 may employ a 0.2 second interval, in addition to the time of travel within the folding field, between the air discharges for folding the right and left panels of the foldable article. Also, the length of each air discharge from the air bars of this application may vary between 0.3–0.5 second for a foldable article width range of 15 inches minimum to 36 inches maximum, the length of the air discharge being proportional to the panel width within such ranges. Other length discharges are workable with the folder disclosed; however, the foregoing range has been found to be satisfactory and is presented by way of example and not limitation. The controller 50 thus also calculates the appropriate length of air discharge to fold the article panels in the various folding steps in accordance with the article (panel) width.

With reference to step 88 in FIG. 8, for the smallest article (approximately 24 inches long) travel of 10 inches within the folding field will have the foldable article in position for the second air discharge. The largest article (approximately 48 inches long) will travel about 24 inches. It will be appreciated by those skilled in the art that the alternating air discharge procedure described in the flow chart of FIG. 8 will be carried out in a folding field of a length of 72 inches. When folding articles of a size sufficiently less than 72 inches in length (and of a lesser corresponding width), two such articles will be proceeding in the folding field simultaneously if the articles are fed at over about 20–24 pieces per minute feed rate.

With larger size foldable articles, for example, articles larger than 48 inches assuming a 72-inch folding field, only one of which can be folded within the folding field on conveyor 14 while moving, the flow chart of FIG. 8 is inapplicable. Whereas the foregoing description pertaining to the steps in FIG. 8 has application in any of various folding apparatuses employing opposed air bars and a moving conveyor for effecting a French fold, in the preferred embodiment of this invention the basic apparatus of the parent application discloses structural features of a preferred folder embodiment for utilization with this inventive concept.

If the length of an article to be folded is calculated to be greater than 48 inches, the system is controlled according to the program steps 106–118, illustrated in FIG. 9. Since the length of the article (L) is known and the speed of the conveyor is known, the controller can determine the length of the article travel (F) in the folding field to conduct the entire French folding process in step 106. As indicated in step 106, the length of conveyor travel for completion of the folding process can vary, for example, from about 15 inches for the smallest article to about 40 inches for the largest article to be processed. Thus, in step 108, the system determines whether the length of the article being folded (L) entering the folding field together with the length of travel necessary to complete the fold (F) will exceed the total length of the folding field itself to determine whether the conveyor 14 needs to stop. If the article may be folded completely within the folding field at the conveyor speed of movement, there is no need to stop the conveyor as indicated in step 110. However, if the length of the article and the length of travel necessary in the folding field to complete the fold is greater than the length of the folding field, a calculation is made to determine the distance of article travel before halting the conveyor to complete the folding. In particular, in step 112 the controller 50 calculates the distance (C) the article must travel in the folding field until it must stop. That is the distance for the foldable article leading edge to reach the end of the folding field or the far end of the air bars. This distance (C) is the difference between the length of the folding field and the distance traveled by the article to completely enter the folding field or the folding field length (72 inches) minus the length of the article (L).

In step 114, the system calculates the minimum conveyor "pause" to enable the French folding operation to be completed. The minimum pause (D) comprises the sum of the time expended during the already calculated length of article travel in the folding field to complete the fold process (F) plus the length of time the article travels (L) in entering the folding field minus the time the article expends in traversing the folding field of 72 inches, or (F) plus (L) minus the time of the folding field traverse. During this minimum pause the folding of the item is completed (step 116) on the conveyor and the processing of the folded article is continued in step 118 described below.

Figure 7A:
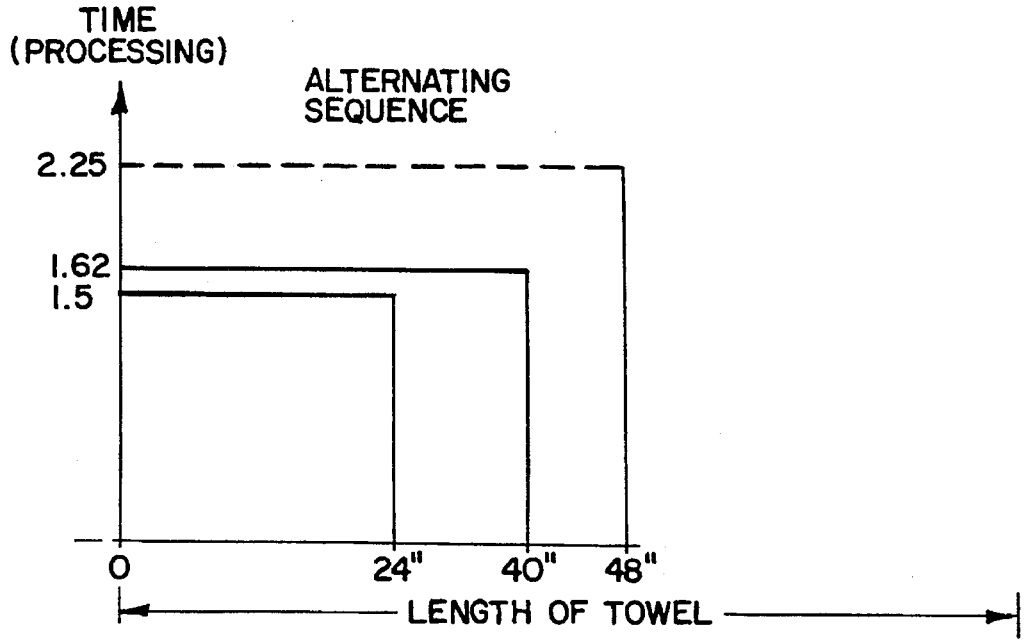
FIG. 7A is a graphical representation of the processing time savings provided by the subject invention when processing smaller foldable articles and utilizing alternating air discharge sequences.

With towel sizes smaller than 48 inches, two towels may be simultaneously processed in the same folding field of 72 inches in length employing the concept of alternating the sequence of air blasts from the opposed air bars, as discussed above in connection with FIG. 8. Also, the minimum times necessary to fold towels less than 48 inches in length is evident from FIG. 7A, which are significantly less than the 2¼ second minimum necessitated by the prior art required article spacing.

Figure 10:
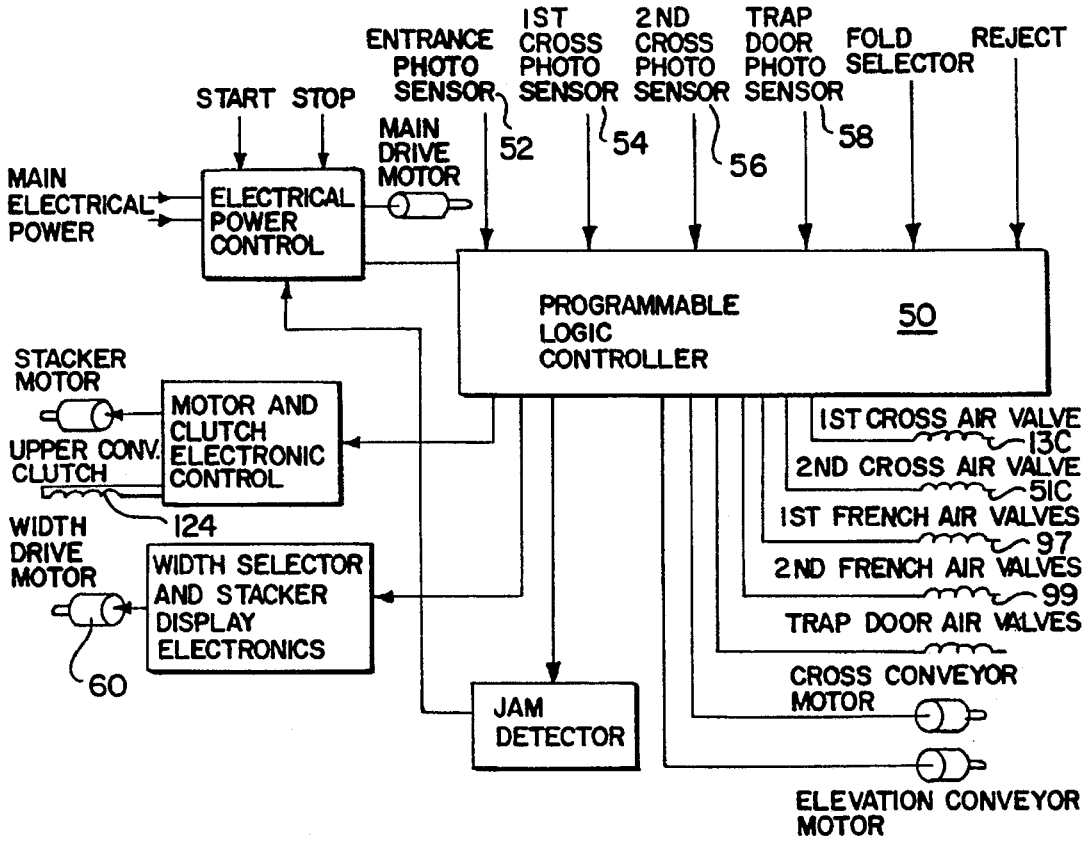
FIG. 10 is a functional block diagram generally schematic illustrating the electrical relationship of various elements of the provided folder.

Once the folded articles are folded, as indicated in steps 98 and 118, the French folded articles, upon leaving upper conveyor 14, are guided by fingers 5 (FIG. 4) to depend in the vertical plane. When the midpoint of a depending foldable article, such as French folded towel 3 of FIG. 1, is centered between roll 22 of upper conveyor 14 and underlying roll 35 of underlying conveyor 26, a solenoid valve 13 controlling the emission of air to tubular air bar 11 is opened by energization of its coil 13C (FIG. 10). A signal from optical sensor 54 (FIG. 1) which senses the article passes to the controller 50, which in turn energizes the coil. Either of spaced sensors 55 disposed to either side of sensor 54 should not sense article 3 as they indicate article misalignment and activation thereof will deenergize solenoid 13. After the article is driven between counter-rotating rolls 22 and 35, the half folded towel is driven to the left on the upper surface of conveyor 26 (see FIG. 4).

Upon reaching the end of conveyor 26 the half folded French folded article 3 is guided around guide fingers 31. When the appropriate length of the depending French folded article 3 is oppositely disposed to air bar 53 upon a signal from sensor 56, solenoid 51 (FIG. 1) opens, has its coil 51C (FIG. 10) activated following sensing of the article by sensor 56, and an air blast drives the article in the form of 3C2 into throat T defined by ribbon portions of the conveyor 26 engaging the left hand roll 35L as well as lower guide roll 34. Throat T is also defined by the ribbons of conveyor 36, the upper runs of which are moving to the right in FIG. 4 in the direction of stacker 40. Surfaces of the stacker which form a trap door are seen in FIG. 3.

A foldable article in the folded condition of 3C2 of FIG. 1 is driven over the surfaces of the trap door 40 by the bottom runs B of conveyor 38. Upon reaching an appropriate location on trap door 40, the folded item 3C2 of FIG. 1 is dropped onto an underlying stack received on horizontal conveyor 42 of FIG. 3. Conveyor 42 moves the formed stacks periodically onto horizontal conveyor 44 and from conveyor 44 onto inclined conveyor 46 for final reception on platform 48 for appropriate disposition by the apparatus operator at the feed end.

The right-hand portion of FIG. 7 illustrates the improvement of the invention of this application wherein a minimum length of time only (time delay) is expended in halting of the conveyor when processing towels greater than 48 inches in length. Previously, in the device of my earlier application, any towel requiring a conveyor hesitation was stopped by controller 50 as soon as it was in the folding field, whereafter the folding process was carried out. The conveyor was then activated to carry the article out of the folding field. Thus, in the prior folding of towels requiring a conveyor stop, the folding was not carried out as the article traversed the folding field. Utilizing the invention of this application, only the minimum time necessary (D of FIG. 9) is expended in halting the conveyor so as to increase the efficiency and production capacity of the provided apparatus.

It will be noted from FIG. 6 that the air discharge from the air bar 32 in the course of moving the left panel portion L over the already folded right panel portion must fold the left panel portion not only over its associated runner 28 but, in addition, over the already folded right panel R. Accordingly, in the preferred embodiment of applicant's invention it is desired that the angle of air discharge of air bar 32 be slightly elevated approximately 15 degrees from the substantially horizontal discharge emitted by the air from the opposed air bar 30. This inclined air discharge is only of significance in conjunction with wider, heavier and longer towels. The heavier towels, however, employ a set sequence of air discharge and accordingly the angle of inclination on the air bar 32 if always the second discharge may be fixed at a higher inclination than the right air bar 30. Such inclination will have no adverse effect on thinner, shorter and narrower towels which utilize variable air discharge sequences. The discharge from bar 32 is preferably at a greater pressure than the discharge from air bar 30 in view of the larger fold radius. Also, coil pairs of either "1st French air valves" 97 or "2nd French air valves" 99 which are referred to in FIG. 10 are sequentially activated by controller 50. These valve pairs and an associated air compressor provide desired air pressures when the valves are activated by the controller 50. By way of example, the "1st French air valves" 97 may control air discharge from a high pressure line (e.g., 70 psi) for use with heavy fabrics. The "2nd French air valves" 99 may control air discharge from a low pressure line (e.g., 35 psi) for use with light weight fabrics.

Figure 11:
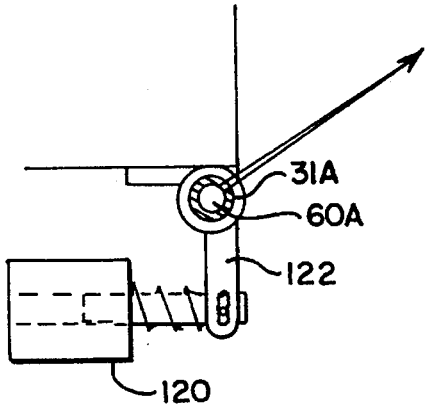
FIGS. 11 and 12 are schematic side elevational views illustrating a piston and cylinder device for rotating air discharge bars which may be employed in embodiments of the provided invention.
Figure 12:
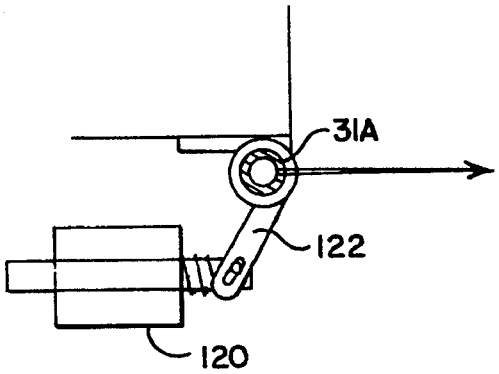

If, however, it is desired to have either air bar capable of having the angular disposition of its air discharge openings immediately adjustable, means such as a piston and cylinder linkage adjusting mechanism attached to opposed rotatable air bars, such as air bar 31A illustrated in FIGS. 11 and 12, may be employed. This figure illustrates a piston and cylinder unit 120 which, by means of a linkage 122, rotatably adjusts the air discharge openings of the mounted air bar 31A. If the piston rod is retracted in the unit 120, the air discharge openings may be rotated downwardly as illustrated in FIG. 12.

The underlying tables I and II provide representative examples of towels which are folded in accordance with the flow charts of FIGS. 8 and 9, respectively.

I

| Article Size | A | B | Pause | Total Time |
|---|---|---|---|---|
| (1) 16" W × 24" L | 24" (.75 sec) | 16" (.5 sec)* | .25 sec (8") | 1.5 sec |
| (2) 20" W × 40" L | 20" (.65 sec) | 16.6" (.55 sec)* | .1 sec (3.2") | 1.62 sec |

(*Includes .2 sec. interval before the second air discharge.)

II

| Article Size | (L) | F | C | D | Total Time |
|---|---|---|---|---|---|
| (3) 26" W × 52" L | 52" (1.625 sec) | 32" (1 sec)* | 20" (.625 sec) | 12" (.374 sec) | 2.37 sec |
| (4) 34" W × 68" L | 68" (2.125 sec) | 36" (1.125 sec)* | 4" (.125 sec) | 32" (1 sec) | 3.49 sec |
| (5) 26" W × 48" L | 48" (1.5 sec) | 24" (.75 sec)* | 24" (.75 sec) | 0" | 1.87 sec |

(*includes .2 sec interval between air discharges)

Article (1) is one of a continuous stream of 16"×24" towels with 24" gap between towels. Total time is for a process rate 1 towel per 48" of conveyor travel (24"L+24" gap) at 32"/sec=1.5 secs.

Article (2) has 12" gap with adjacent towels in a stream of 20"×40"L towels. Total time is for a process rate of 1 towel per 52" of conveyor travel (40"L+12" gap) at 32"/sec=1.62 secs.

Article (3) processed at the rate of 1 article per 2.37 secs. (1.625 secs to enter folding field+0.374 sec delay [D]) plus 0.37 sec which results from the 12 inch gap between the pieces traveling at about 32"/sec.

Article (4) processed at the rate of 1 article per 3.49 secs. (2.125 secs to enter folding field+1 sec delay [D]) plus 0.37 sec which results from the 12 inch gap between the pieces traveling at about 32"/sec.

Article (5) processed at the rate of 1 article per 1.87 secs. (1.5 secs to enter folding field) plus 0.37 sec which results from the 12 inch gap between the pieces traveling at about 32"/sec.

It will be noted from above Table I that the processing times for the articles indicated are less than 2 seconds per article. The production increase made possible by alternating the air discharge sequence is evident by comparing such processing times with the 2.25 second minimum processing times necessary when employing the folder of my copending application. Such production figures assume a conveyor speed of 32"/second and a folding field 72 inches in length.

It is also evident from the above Table II that whereas articles processed by the folder of my copending application came to a full stop after fully entering the folding field, such articles processed in the folder herein disclosed pause after the leading edges thereof are at the far end of the folding field. During such conveyor movement a portion of the French folding operation is taking place. Accordingly, the present folder decreases the folding time over that previously necessary by that part of the folding process which takes place as the article travels between the positions when fully in the folding field until it arrives at the end of such field, i.e., the time to travel (C) of step 112 of FIG. 9 of the drawing.

Figure 7B:
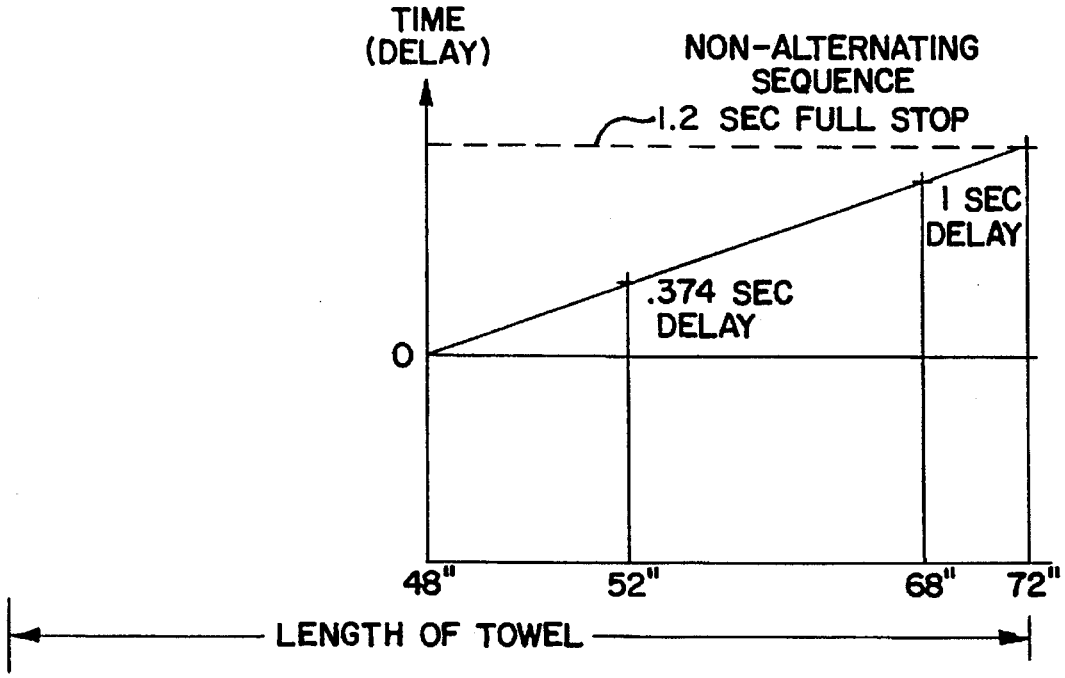
FIG. 7B is a graphical representation of the minimum conveyor delays provided by the subject invention when processing larger foldable articles, the time delays being proportional to the article lengths.

It will be noted from FIG. 7B of the drawing that the conveyor delays decrease as the article size decreases and approaches 48 inches in length. It is also evident that the delays are proportional to the article lengths. The time savings provided by the invention when the conveyor must halt are directly proportional to the folding operation portion which may be completed prior to arriving at the end of the folding field; the greater the completion the shorter the delay and the total processing time.

Although the foregoing description has been presented in conjunction with a conveyor speed of approximately 160 feet per minute, it will be understood that a main drive motor employed in driving the conveyors (referred to in the block diagram of FIG. 10) may be driven at a variable speed and that through an encoder or the equivalent, the speed of the motor operation may be monitored by the controller 50 to effect appropriate control of the timing of the various operations performed and above-described. Although lower conveyor 26 may be continuously driven by the main drive motor, upper conveyor 14, on which the French folds of this application is carried out, must be capable of substantially instantaneous stopping and actuation. FIG. 10 refers to energizing coil 124 for a clutch which may be positioned between a sprocket (not illustrated) for driving an upper conveyor roll 22 and the end of such roll 22. Such sprocket may be rotatably driven by a belt or a drive chain engaging a sprocket of the underlying continuously driven conveyor roll 26. Signals from controller 50 maintain the clutch coil energized when movement of upper conveyor 14 is desired and deenergize such coil when the conveyor is to be stopped in a manner known in the art.

FIG. 10 also refers to a jam detector. The detector is actuated to cut off electrical power to the apparatus if a foldable article is sensed by entrance photo-sensor 52 does not arrive at a following photosensor within a time limit calculated by the controller 50. Such delay in arrival is evidence of jamming or other malfunction and electrical power input to the conveyor motor is terminated.

FIG. 10 also illustrates a "reject" button actuated by the operator upon noting a defect in a foldable article fed into the folder on the feed conveyor, after the initial portion of the article is already passed onto the upper conveyor 14. Upon noting such a defective article the operator, upon pushing the reject button, inactivates first cross air valve 13 resulting in no air being emitted by the first cross air bar 11, allowing the foldable article to drop into an underlying collection basket at the end of conveyor 14.

Figure 1F:
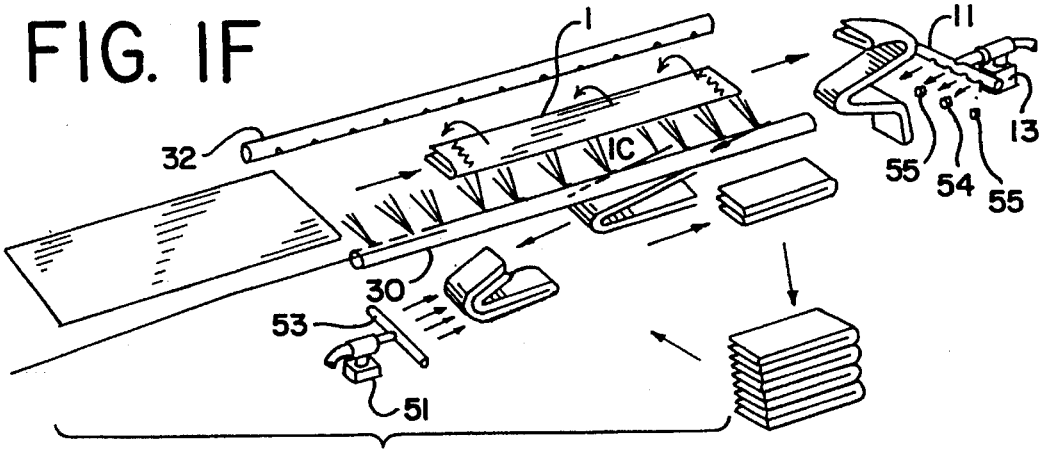

Although a plurality of folding operations has been above described, these operations employ many elements currently commercially available. It will be appreciated by those skilled in the art that the apparatus above-described, in addition to forming French folds in foldable articles which may be transversely cross-folded into halves (FIG. 1F) or quarters (FIG. 1) or other fractions, is also adapted for the folding of foldable flat pieces longitudinally in half when a single air bar is employed in conjunction with a single runner 28.

It is believed apparent to those skilled in the art that the provided apparatus, although of a compact size which occupies a minimum of valuable laundry space, is able to process a large variety of foldable articles in a rapid, highly efficient manner. As above-described in detail, the provided apparatus is able to rapidly process a series of relatively small foldable articles, i.e., small relative to the length of the folding field, utilizing pauses in air discharge from the described air bars for a minimum of time when necessary for allowing a prior foldable article to exit the folding field prior to a second panel folding operation.

The provided apparatus also is able to fold in a rapid manner larger foldable articles which are sufficiently large relative to the folding field as to require a halt in the conveyor movement. The stationary periods of the conveyor are maintained at an absolute minimum dictated by the size of the foldable article relative to the length of the folding field.

A structural improvement present in folder 10 not found in the folder of the parent applications comprises the use of hardened threads for greater wear resistance in the threaded adjusting rods, such as rods 37 and 43. These threads engage nuts having a series of load carrying ball bearing races with ball bearing returns. Such ball bearing screws are well known in the art, such as are manufactured under the tradename Warner by Warner Electric of South Beloit, Ill. and sold as ball screw assemblies.

The above description has been presented with respect to a folder employing a folding field approximately 72 inches in length and parallel runners adapted to be moved apart those distances desirable for forming panels approximately a third of the width of the foldable articles normally to be processed, such as hand towels, face towels and pool towels. The folding field and the length of the air bars may vary from that described in detail above if required for the processing of foldable articles having a specific dimension or dimensions different from those foldable articles discussed in this application.

It is believed that the foregoing has made apparent to those skilled in the art a number of modifications which may be made in the embodiments described above.

Thus, although optical sensors above-described measure the length of foldable articles entering the folding field, a plurality of aligned sensors or equivalent measuring means may be used to measure the width. In standard size articles in which the widths are accompanied by a known length, as in the case of, for instance, of towels, both dimensions are immediately known. Both dimensions may, of course, be measured on each processed article. The width measuring sensors may immediately adjust the runner interval to provide a desired panel width in the course of the panel folding for a French fold. Such sensors used to measure the width may be used to determine the time period of air discharge of the air bars.

Figure 13:
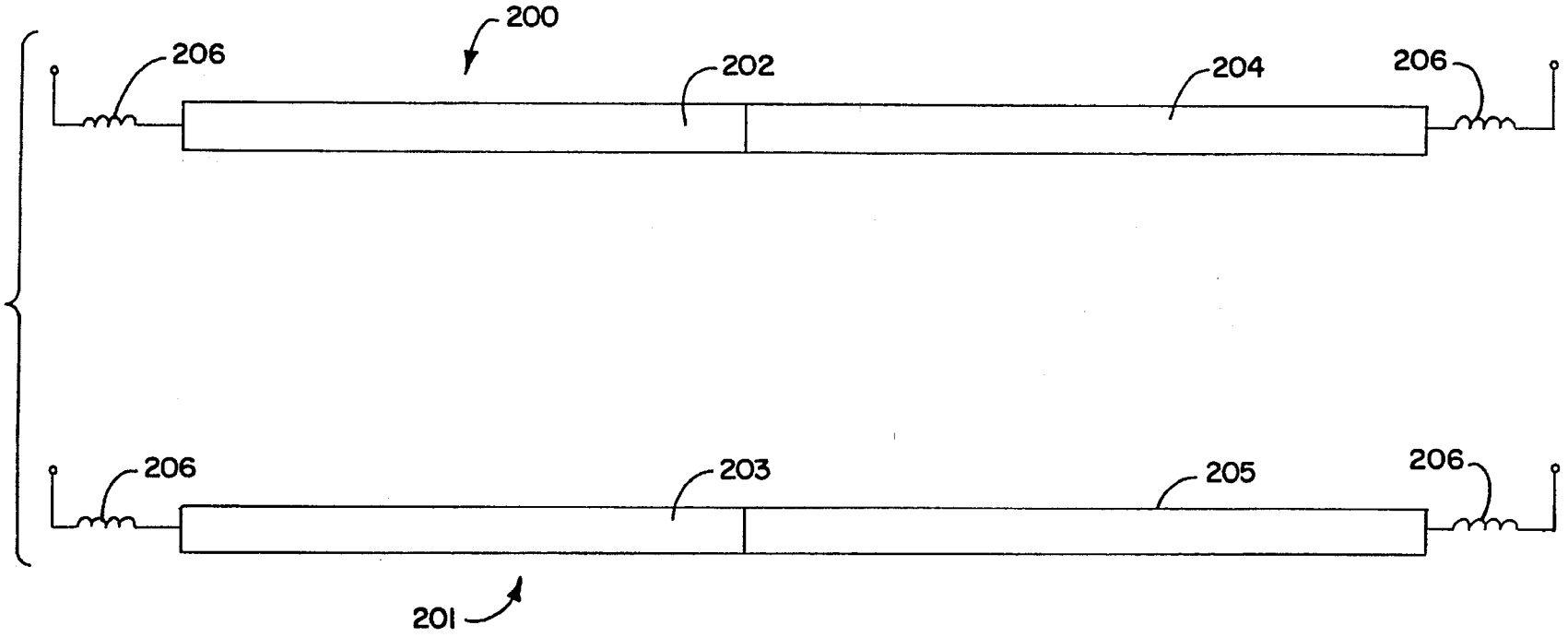
FIG. 13 is a simplified view of an alternate embodiment of the invention incorporating air bars formed as split manifolds.

FIG. 13 illustrates an alternate embodiment of the invention in which each of the opposed air bars, identified with the reference numerals 200 and 201, may be formed as split manifolds defining separate compartments 202, 203, 204 and 205. A solenoid valve 206 may be connected to each of the compartments 202, 203, 204 and 205 to enable the air discharge from each compartment 202, 203, 204 and 205 and each of the air bars 200 and 201 to be controlled separately.

In this embodiment. the position of the article to be folded relative to the compartments 202, 203, 204 and 205 may be determined in a manner as discussed above to enable folding of the articles without unfurling of subsequent articles. In addition, the length of each of the compartments 202, 203, 204 and 205 may be selected to optimize the speed of the folding operation. The sequence of air discharge from each of the compartments 202, 203, 204 and 205 may be controlled in a similar manner as discussed above to prevent unfurling of subsequent articles while also optimizing the efficiency of the apparatus.

The programmable logic controller 50, in accordance with the present invention, is illustrated in FIGS. 14–20. As discussed above, the flow diagrams for the controller 50 are illustrated in FIGS. 8 and 9, while the source code is included as Appendix 1.

Figure 14:
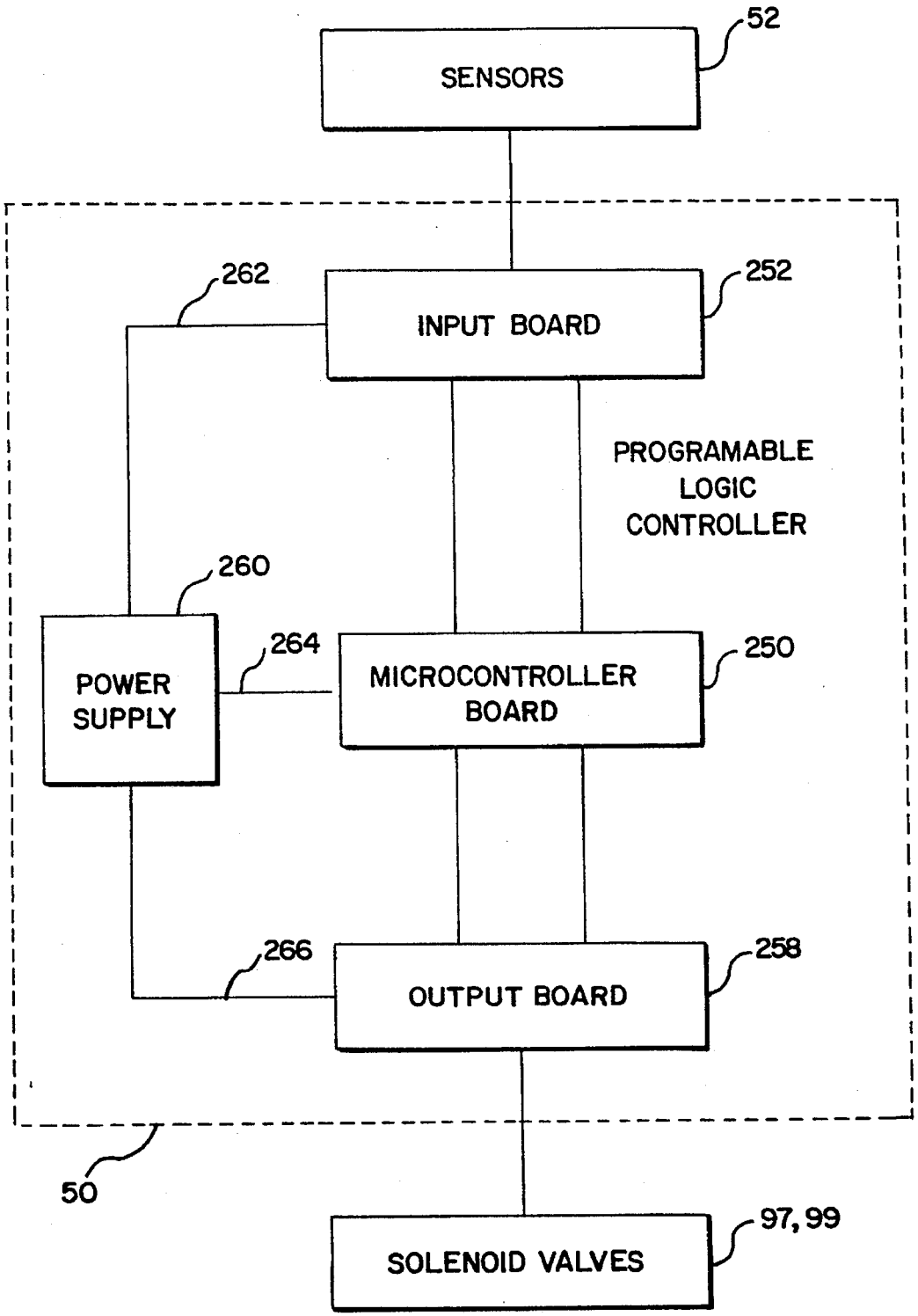
FIG. 14 is a block diagram of the programmable logic controller in accordance with the present invention, shown connected to the sensors and solenoids which form a portion of the present invention.

Referring to FIG. 14, the programmable logic controller (PLC) 50 in accordance with the present invention is shown within the dashed box identified with the reference numeral 50. The controller 50 includes a microcontroller board 250, which preferably includes an 8-bit Intel Microcontroller, Model No. D8752BH and an on-board pulse generator/counter for generating and counting pulses to form the functions discussed above. The PLC 50 also includes an input board 252, one or more input transceivers 254 (FIG. 20), one or more output latches 256 (FIG. 20), an output board 258 (FIG. 14) and a power supply 260 (FIG. 14).

As shown in FIG. 14, the power supply 260 is used to provide electrical power to the input board 252, the microcontroller board 250 and the output board 258. The power supply 260 is adapted to supply 24 volts AC (24 VAC), 24 volts DC (24 VDC) and 5 volts DC (24 VDC). The 24 VAC is used primarily for the solenoids 97 and 99. The 24 VDC is used for the sensors 52, as well as the input board 252. In addition, the 5 volt DC is applied to the input board to provide a 0–5 volt DC output. The 5 VDC also is used to provide power to the microcontroller 250. The connections between the power supply 260 are made by way of the multi-conductor electrical cables 262, 264 and 266.

Figure 15:
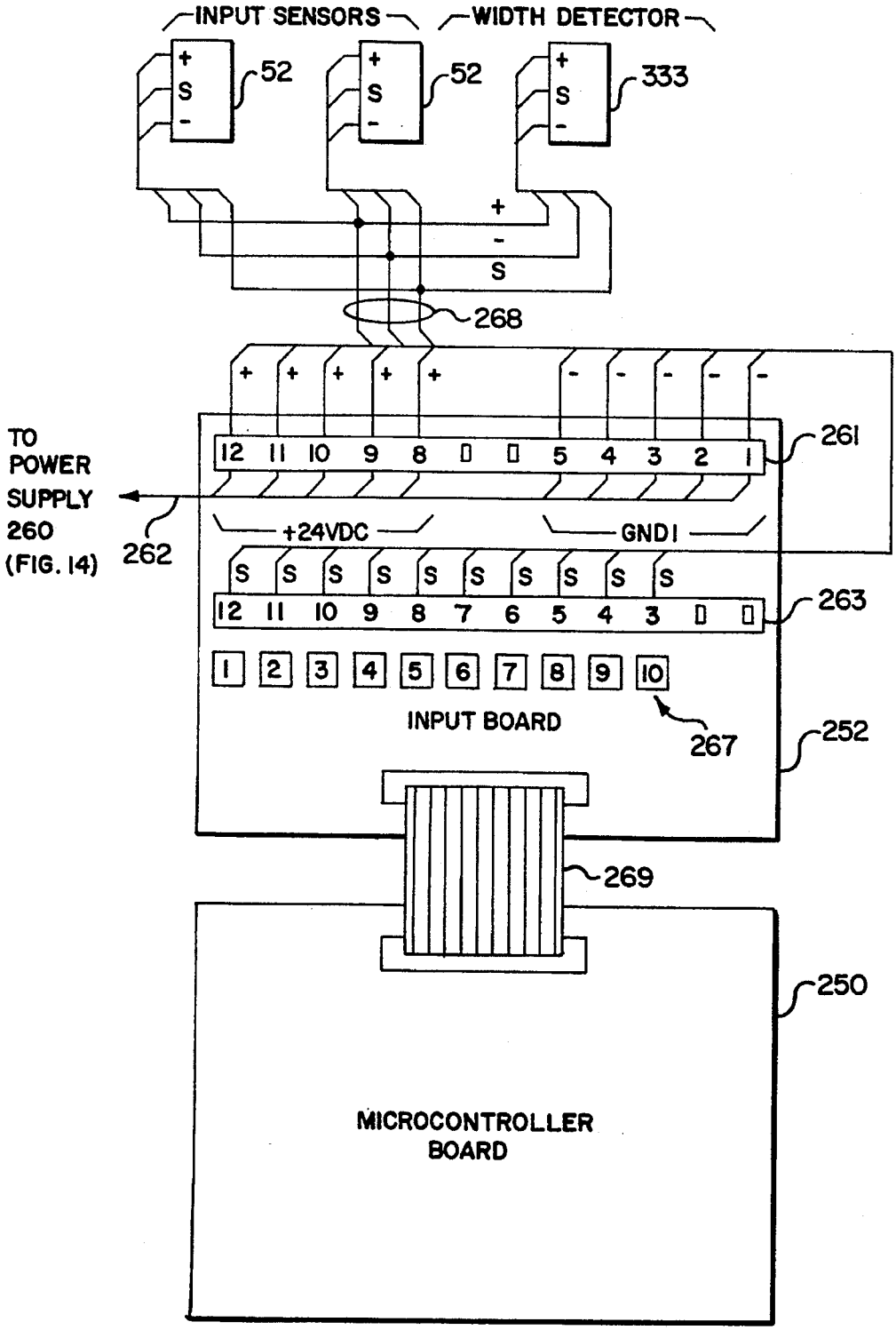
FIG. 15 is an electrical wiring diagram illustrating the electrical connections between the sensors and the input board and between the input board and the microcontroller in accordance with the present invention.
Figure 17:
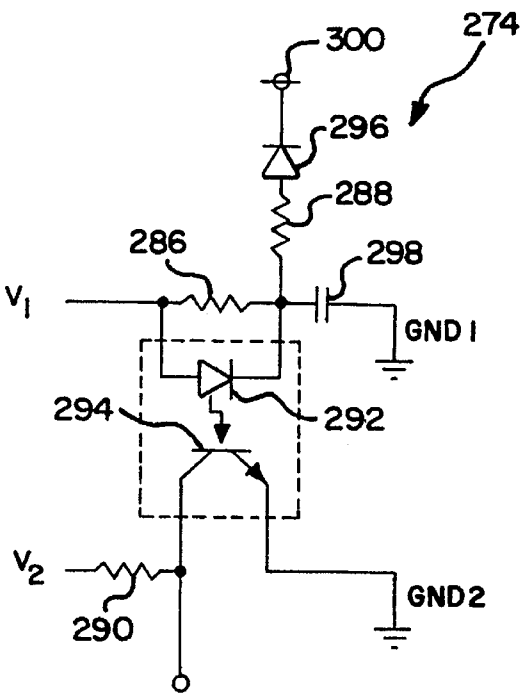
FIG. 17 is an electrical schematic diagram of the input board illustrated in FIG. 16.
Figure 16:
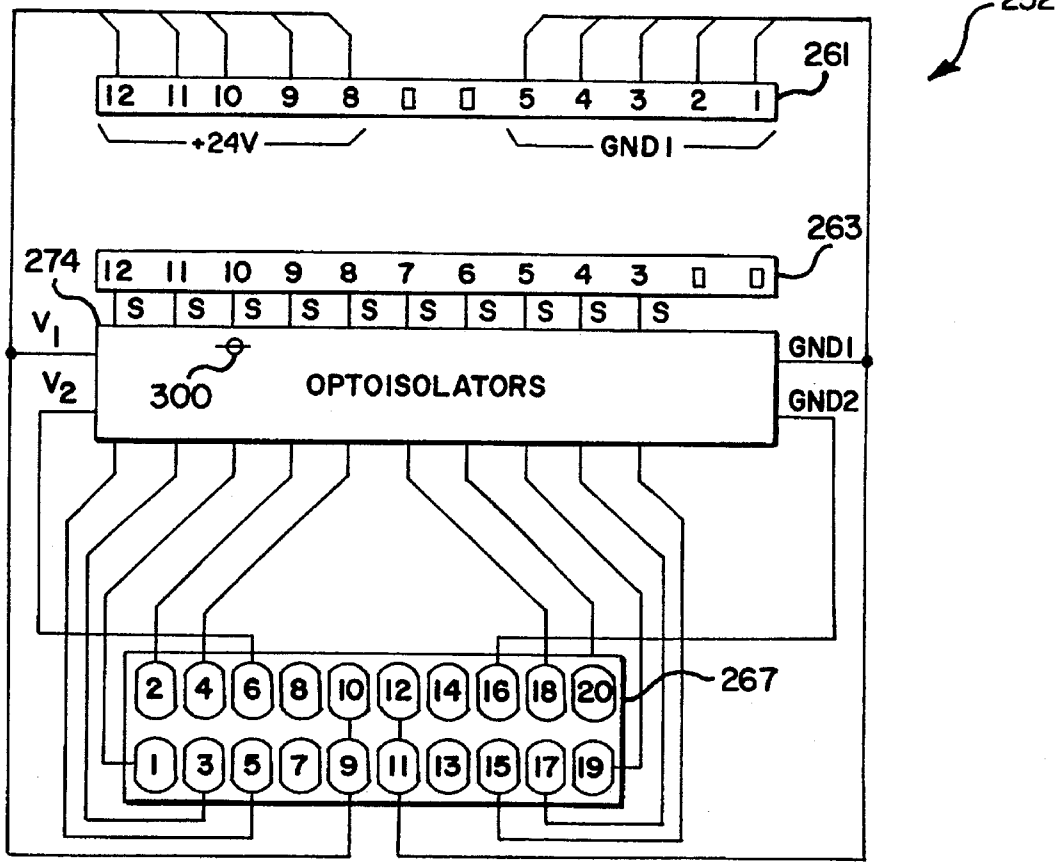
FIG. 16 is a detailed electrical connection diagram of the input board in accordance with the present invention.

The input board 252 is illustrated in more detail in FIGS. 15–17. Referring first to FIG. 15, the sensors 52 and 333, of which three are shown, for example, are electrically connected to the input board 252 by way of a multiple conductor electrical cable 268. As shown, each of the sensors 52 and 333 has three terminals. Two terminals, identified as + and –, are used for the electrical power supply connection (e.g., 24 VDC) to the sensor 52. The remaining terminal, identified as "S," is used for the signal. The power supply 260 is connected to a terminal block 261 on the input board 252 by way of the electrical cable 262. The + and – terminals of each of the sensors 52 are connected to the terminal block 261 to provide electrical power to the sensors 52. The signal terminal S of each of the sensors 52 and 333 is connected to an input terminal block 263 on the input board 252 and, in turn, to the microcontroller board 250 by way of an electrical connector 267 and a ribbon cable 269. An optical isolation circuit 274, discussed in more detail below and illustrated in FIGS. 16 and 17, is electrically connected between the input terminal block 263 and the electrical connector 267.

The input board 252 is shown in more detail in FIGS. 16 and 17. In particular, the input board 252 is formed as an optical isolator to provide electrical isolation between the sensors 52 and 333 and the micro-controller board 250, as well as provide electrical power to the sensors 52 and the optical isolation circuit 274. More particularly, as discussed above, the power supply 260 is connected to the input board 252 to provide 5 VDC electrical power to the sensors 52 and 333 as well as 24 VDC and 5 VDC to the optical isolation circuit 274 included as part of the input board 252. As shown, the signals from each of the sensors 52 and 333 (i.e., the S terminal) are connected to the terminal block 263. These signals S are, in turn, connected to the optical isolation circuit 274. and, in turn, to the electrical connector 267.

Referring to FIG. 17, the optical isolation circuit 274 includes three resistors 286, 288 and 290, a light emitting diode (LED) 292, a photo transistor 294, a diode 296 and a capacitor 298. The cooperation of the LED 292 and the photo transistor 294 provide the optical isolation. The signal from each of the sensors 52 and 333 is applied to a terminal 300 of the optical isolation circuit 274. During normal operation, the output of the sensors 52 and 333 is high. This high output at the terminal 300 keeps the diode 296 from conducting and, hence, the voltage available at the cathode of the LED 292 at the same potential as V1 to prevent it from conducting. Once a foldable article is sensed by the sensor 52 or the sensor 333 is activated, the output goes low causing the voltage at the terminal 300 to go low to force the diode 296 to conduct which, in turn, forces the voltage at the cathode of the LED 292 to drop as a result of the voltage drop across the pull down resistor 288. This, in turn, causes light to be emitted to the phototransistor 294 to cause the phototransistor 294 to conduct. The voltage V2, i.e., 5 VDC, is applied to the collector of the photo-transistor 294 while the emitter is grounded to provide a 0–5 VDC output. During a normal condition, when the photo transistor 294 is not conducting, the collector is high. Once the photo transistor 294 begins conducting, the collector goes low to indicate that an article is being sensed by the sensors 52 or 333. The 0–5 VDC output signals from the phototransistors 294 are connected to the electrical connector 267.

Figure 20:
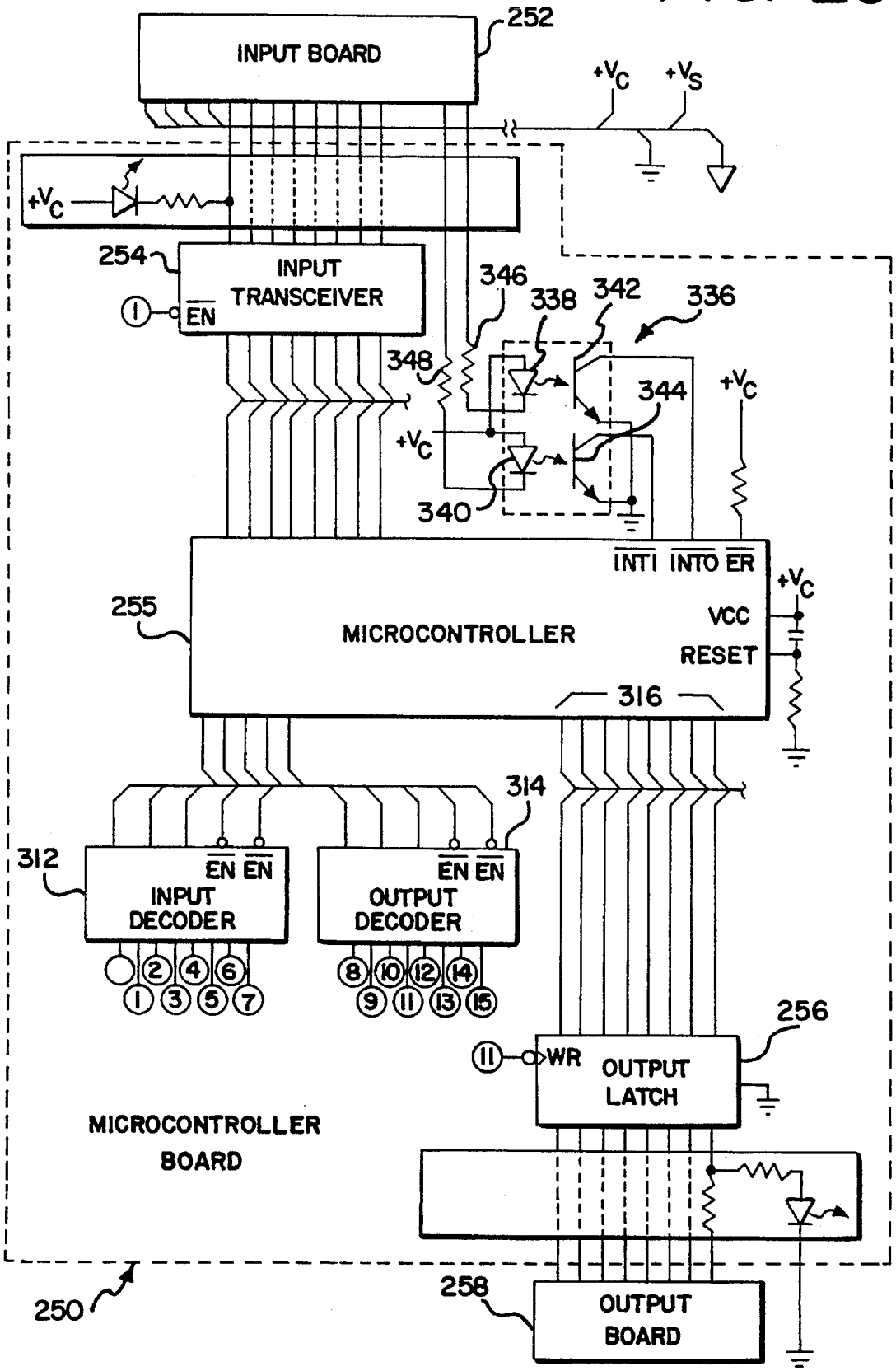
FIG. 20 is an electrical connection diagram illustrating various electrical connections to the microcontroller in accordance with the present invention.

The output signals from the phototransistors 294 (available at the electrical connector 267) are connected to one or more transceivers 254 on the microcontroller board 250, illustrated in FIG. 20. These transceivers 254 may be octal bus transceivers, for example, Texas Instruments Model No. SN54HCT45 which have three state outputs. During normal conditions (i.e., the transceivers 254 not enabled), the output of the transceivers 254 are in a high impedance state. Once the transceiver 254 is enabled by way of pulling the enable (EN) input low, the signals available on the input of the transceiver 254 are available on the output which, in turn, is applied to an 8-bit databus on the microcontroller board 250 to enable the microcontroller 255 to read the status of each of the sensors 52 and 333 in order to perform the calculations and functions discussed above.

The transceivers 254 are selected by the microcontroller 255 by way of a 3–8 bit input decoder multiplexer 312. The decoder multiplexer 312 may be, for example, a Texas Instruments Model No. SN54HCT138. The input to the decoder 312 is connected to a 5-bit databus that is used to select the decoder 312 and, in turn, the transceiver 254. In particular, as will be discussed in more detail below, the system also includes a 3–8 bit output decoder 314. Thus, one or more bits on the 8-bit bus may be used to select between the input decoder 312 and the output decoder 314. The remaining bits may be used to select up to, for example, 8 transceivers 254 to enable the output signals from the sensors 52 and 333 to be read by the microcontroller 255. In applications where many inputs are required to be read by the microcontroller 255, multiple transceivers 254 are contemplated. In such situations, the 3–8 bit decoder 312 is used to select between the multiple transceivers up by pulling the respective enable EN inputs for the selected transceivers 254 low. In situations where only a single transceiver 254 is required, the 3–8 bit input decoder 312 can be eliminated and a single line used to select or enable the transceiver 254.

As mentioned above, a number of calculations and functions are made by the controller 50 to control the energization of the solenoids 97 and 99. In particular, the control of the solenoids 97 and 99 is by way of an 8-bit data bus 316 that is connected to one or more output latches 318. These output latches 256 may be octal D-type transparent latches with three state outputs, such as Texas Instruments Model No. SN54HCT573. The output data bus 316 is connected to the inputs of each of the octal latches 256. The octal latches 256, in turn, are connected to the output boards 258, as will be discussed in more detail below. Normally, when the output latch 256 is not enabled, the output of the latch 256 is a high impedance state. Once the latch 256 is selected, the output control signals from the microcontroller 255 are available at the latch outputs.

The output latches 256 are selected by way of the 3–8 bit output decoder 314. As mentioned above, the output decoder 314 may be used to select up to 8 latches 256 by pulling a write input WR low. As shown, a single output latch 256 is utilized and, thus, the output decoder 314 could be eliminated in such an application. Once the output latch 256 is enabled, the control signals from the microcontroller 255 are available at the output of the latch 256. These signals, in turn, are connected to the output board 258 by way of an appropriate electrical conductor 320 (FIG. 18), such as a ribbon conductor to control the solenoid valves 97 and 99.

Figure 18:
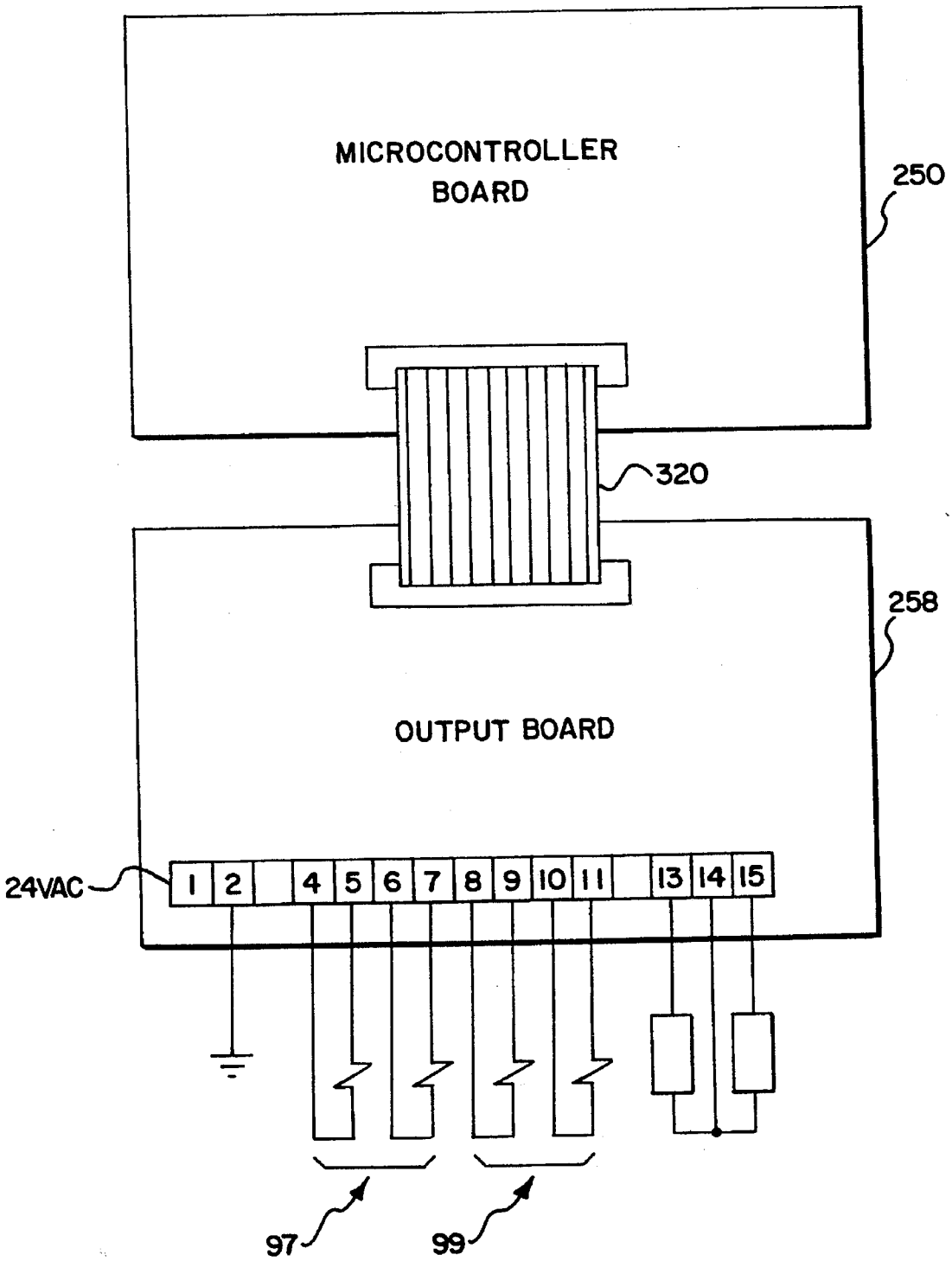
FIG. 18 is an electrical wiring diagram illustrating the electrical connections between the microcontroller and the output board and between the output board and the solenoid valves in accordance with the present invention.
Figure 19:
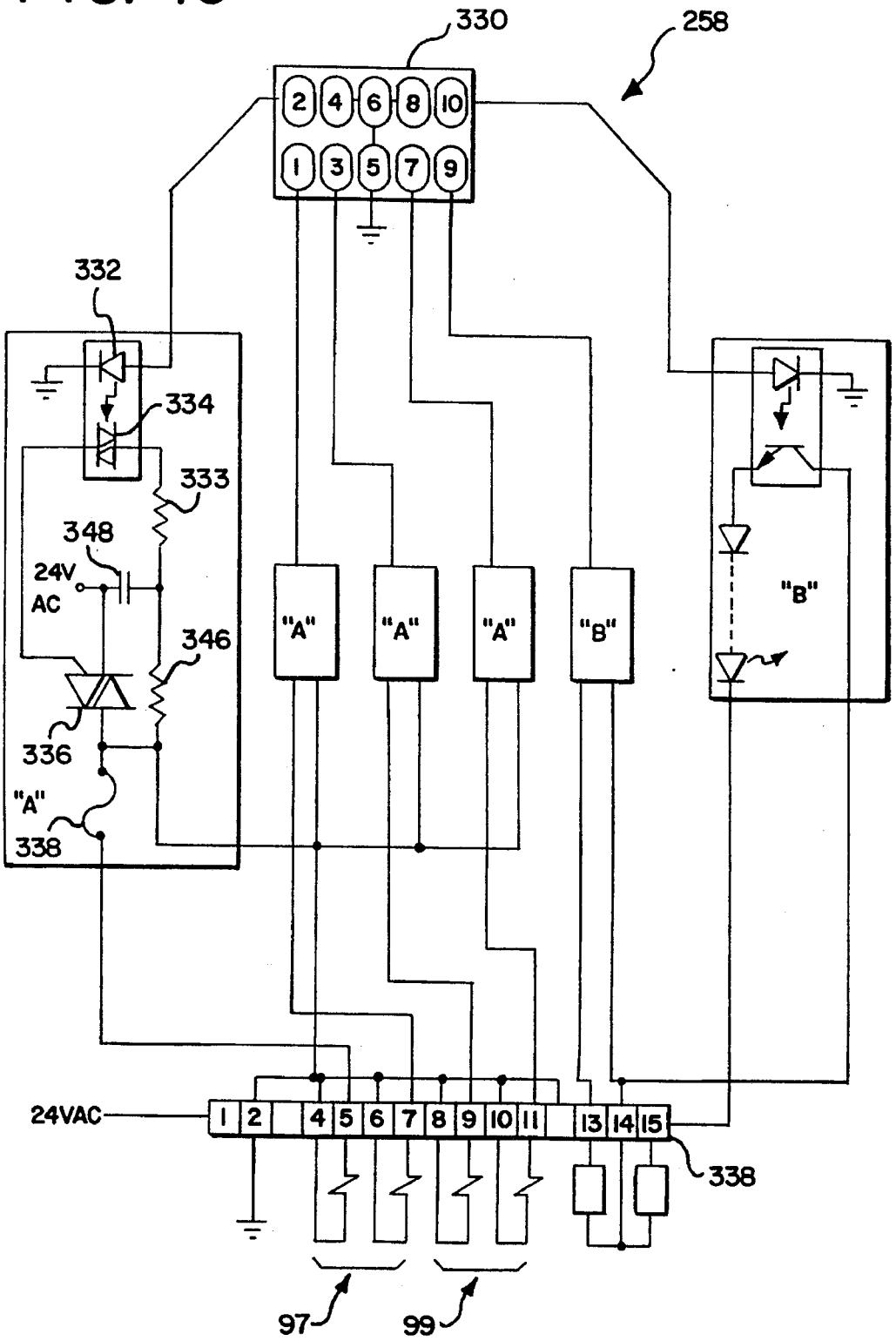
FIG. 19 is an electrical schematic and wiring diagram of the output board in accordance with the present invention.

With reference to FIGS. 18 and 19, the output signal (i.e., latch output) from the output card 258 is applied to the connector 330 which, in turn, is connected to an LED 332 whose cathode is connected to ground. A high output from the microcontroller 255 forward biases the LED be emitted therefrom. The emission of light from the LED 332 causes a photo responsive DIAC 334 to conduct. The photo responsive DIAC 334 acts as a gate signal for a TRIAC 336 which, in turn, is connected to the solenoid valves 97 and 99 on one end and a 24 volts source of AC power on the other end. A serially connected resistor 333 serves to limit the gate current to the power TRIAC 336. Thus, any time the control signal from the microcontroller 255 goes high, causing the light emitting diode 332 to conduct, that signal, in turn, will gate the TRIAC 336 to energize one of the solenoid valves 97 or 99. More particularly, a source of 24 volts AC electrical power is applied to an electrical terminal block 338 on the output board 258. This voltage 24 VAC, in turn, is connected to the power TRIAC 336 which, in turn, is connected to a fuse 338 and, in turn, to one of the solenoid valves 97 and 99. The other end of each of the solenoid valves 97 and 99 is connected to ground through the terminal block 338. A resistor 346 and a capacitor 348 are connected across the TRIAC 336 to form a snubber circuit to enable the TRIAC 336 to shut off during conditions in which inductive loads are switched.

In operation, the TRIAC 334 is normally in a non-conductive state, thus keeping the solenoid valves 97 and 99 deenergized. Once the LED 332 is biased by way of a control signal from the microcontroller 255, the DIAC 334 acts to gate the TRIAC 336 to provide an electrical connection between the power supply of 24 volts AC and a solenoid 97 or 99. The solenoid 97 or 99 will remain energized as long as the control signal is available at the microcontroller 255 output. Once the output signal at the microcontroller 255 output goes low, the LED 332 stops conducting which, in effect, removes the gate signal from the TRIAC 336 to disconnect electrical power from the solenoid 97 or 99.

As mentioned above, the length of time that each of the solenoid 97 and 99 is energized is a function of the width of the foldable article to be folded. The width of each of the foldable articles is determined by a width detector 333 (FIG. 15), connected to the input board 252 by way of the electrical multi-conductor cable 268. In normal operation, the width of the foldable article may be manually input by the machine operator. Alternatively, multiple width detectors can be used to determine the width of the foldable articles since for many foldable articles, such as towels, are only available in a few predetermined widths. This width detector 333 may be tied to an interrupt INT1 on the microcontroller 255 to interrupt the microcontroller 255 upon detection of a foldable article having a different width than the previous article through the system in order to redetermine or look up a predetermined time period for keeping the solenoid 97 or 99 energized which corresponds with the particular width of the foldable item.

As shown, the width detector 333 is shown in FIG. 20 as alternatively being connected to a separate optical isolation circuit 336 which includes a pair of LED's 338 and 340, a pair of photoconductive transistors 342 and 344 and a pair of pull down resistors 346 and 348 instead of going through the input board 252 for isolation. As long as the output of the width detector 333 is electrically isolated from the microcontroller board 250, either method is acceptable.

Although the foregoing description has been primarily directed to the folding of towels, the described folder and method are applicable to the folding of hospital gowns and other sheet material in which the formation of a French fold is desirable.

It is intended, therefore, that this invention be limited only by the scope of the appended claims.

APPENDIX 1

```
;
;************************
;PRIMARY FOLD CALCULATION
;************************
;
;GET LENGTH
;
PCALC:  MOV     A,INACCL
        ADD     A,INACCR
        ADD     A,INACCF
        MOV     TEMP1,A
;
;DUMP IF TOO SHORT TO FOLD
;
        CJNE    A,LMIN,PSFA
PSFA:   JNC     PSFB
        LJMP    PSM
;
;CHECK FOR TOO CLOSE REJECT (FEEDING TOO FAST)
; - PREVIOUS STILL FOLDING WHEN THIS DONE MEASURING (PBUSY)
; - CLOSER THAN MINIMUM INTERVAL (48" BETWEEN TAILS)
; - GAP BETWEEN TOWELS < 15"
;
PSFB:   JB      PBUSY,PSFD      ;PREVIOUS STILL FOLDING!
        MOV     A,PLOC
        CJNE    A,#160,PSFC     ;PREVIOUS AT LEAST 48" AWAY ? (1.6 SEC)
PSFC:   JC      PSFD
        SJMP    PSG
PSFD:   MOV     MSGR,#39H       ;FEEDING TOO FAST!
        SETB    REJC
        LJMP    PSM
;
;BRANCH FOR PROPER FOLD:
; - HALF IF LEFT OR RIGHT BIT SET
; - HALF IF ONE SIDE > 1/2 TOTAL
; - HALF IF PIECE < 36" & 1 SIDE > 4"
; - OTHERWISE FRENCH
;
PSG:    SETB    PBUSY
        MOV     A,TEMP1
        MOV     PLEN,A
        MOV     PLOCL,A
        JB      PL,PSGI
        JB      PR,PSGJ
        MOV     B,#2
        DIV     AB
        CJNE    A,INACCL,PSGA   ;LEFT SIDE > 1/2 TOTAL?
PSGA:   JC      PSGI
        CJNE    A,INACCR,PSGB   ;RIGHT SIDE > 1/2 TOTAL?
PSGB:   JC      PSGJ
        SJMP    PSH
        CJNE    A,#40,PSGC      ;PIECE < 36" LONG?
```

```
PSGC:   JNC     PSH             ;NO. DO FRECNH!
        MOV     A.INACCL
        CJNE    A,#14,PSGD      ;IS ONE SIDE > 4"?
PSGD:   JNC     PSGI             ;DO LEFT FOLD!
        MOV     A.INACCR
        CJNE    A,#14.PSGE
PSGE:   JNC     PSGJ
        SJMP    PSH
PSGI:   LJMP    PSI
PSGJ:   LJMP    PSJ
;
;FRENCH FOLD CALCULATION
; - CALCULATE AND LOAD BLAST LENGTHS AND INTERVAL
; - IF PLOC > 72", START ON LEFT, OTHERWISE START ON LAST SIDE USED (PTOG)
; - CALCULATE DELAY TO FOLD STARTING
; - CALCULATE CONVEYOR STOP/START IF NECESSARY
;
PSH:    MOV     TTP2,#25        ;.25 SEC INTERVAL
        LCALL   CLCALC          ;CALCULATE BLAST LENGTH
        MOV     TP1,A
        MOV     TP2,A           ;LOAD FOR BOTH SIDES
        ADD     A,TTP2
        ADD     A,TP2           ;GET TOTAL TIME
        MOV     TEMP1,A         ;TEMP1 = TOTAL FOLD TIME
;
        MOV     A.PLOC          ;HOW FAR IS PREVIOUS TOWEL AWAY?
        CJNE    A.#240.PSHA
PSHA:   JC      PSHC            ;START ON LAST SIDE USED IF < 72"
        SETB    PTOG            ;START ON LEFT (IMMEDIATELY) IF > 72"
PSHB:   MOV     TTP1,#1
        INC     TEMP1           ;UPDATE TOTAL FOLD TIME
        SJMP    PSHD
;
PSHC:   MOV     A.#240          ;IF PREVIOUS TOWEL < 72"
        CLR     C               ;CALCULATE DELAY TO START OF FOLDING
        SUBB    A.PLOC          ;(72" - PLOC - TP1 - TTP2)
        JC      PSHD            ;IF ANSWER IS NEGATIVE, START IMMEDIATE
        SUBB    A.TP1

        JC      PSHB
        SUBB    A.TTP2
        JC      PSHB
        JZ      PSHB
        MOV     TTP1.A
        ADD     A.TEMP1
        MOV     TEMP1.A         ;UPDATE TOTAL FOLD TIME!
PSHD:   LJMP    PSK             ;GO CHECK FOR CONVEYOR PAUSE
;
;HALF FOLD LEFT CALCULATION
; - CALCULATE AND LOAD BLAST LENGTH
; - CALCULATE START DELAY ONLY IF LAST BLAST ON OPPOSITE SIDE
; - SET PTOG FOR PROPER SIDE
; - CLACULATE CONVEYOR STOP/START
;
PSI:    LCALL   CLCALC          ;CALCULATE BLAST LENGTH
        LCALL   ADHALF
        MOV     TP2,A
```

```
:
        MOV     TTP2,#1
        JB      PTOG,PS1C       ;START IMMEDIATE IF LAST FOLD ON THIS SIDE
        MOV     A,PLOC          ;HOW FAR IS PREVIOUS TOWEL AWAY
        CJNE    A,#240,PS1A
PS1A:   JNC     PS1C            ;START (IMMEDIATELY) IF > 72"
:
PS1B:   MOV     A,#240          ;IF PREVIOUS TOWEL < 72" AWAY AND LAST FOLD OPPO
SITE
        CLR     C               ;CALCULATE DELAY TO START OF FOLDING
        SUBB    A,PLOC          ;(72" - PLOC)
        JC      PS1C            ;IF ANSWER IS NEGATIVE, START IMMEDIATE
        MOV     TTP2,A          ;IF NOT, LOAD DELAY!
:
PS1C:   MOV     A,TTP2
        ADD     A,TP2
        MOV     TEMP1,A         ;UPDATE TOTAL FOLD TIME
        SETB    PTOG            ;SET FOR LEFT SIDE BLAST
        LJMP    PSK             ;GO CHECK FOR CONVEYOR PAUSE
:
;HALF FOLD RIGHT CALCULATION
; - CALCULATE AND LOAD BLAST LENGTH
; - CALCULATE START DELAY ONLY IF LAST BLAST ON OPPOSITE SIDE
; - SET PTOG FOR PROPER SIDE
; - CALCULATE CONVEYOR STOP/START
:
PSJ:    LCALL   CLCALC          ;CALCULATE BLAST LENGTH
        LCALL   ADHALF
        MOV     TP2,A
:
        MOV     TTP2,#1
        JNB     PTOG,PSJC       ;START IMMEDIATE IF LAST FOLD ON THIS SIDE
        MOV     A,PLOC          ;HOW FAR IS PREVIOUS TOWEL AWAY?
        CJNE    A,#240,PSJA
PSJA:   JNC     PSJC            ;START (IMMEDIATELY) IF > 72"
:
PSJB:   MOV     A,#240          ;IF PREVIOUS TOWEL < 72" AWAY AND LAST FOLD OPPO
SITE
        CLR     C               ;CALCULATE DELAY TO START OF FOLDING
        SUBB    A,PLOC          ;(72" - PLOC)
        JC      PSJC            ;IF ANSWER IS NEGATIVE, START IMMEDIATE
        MOV     TTP2,A          ;IF NOT, LOAD DELAY!
:
PSJC:   MOV     A,TTP2
        ADD     A,TP2
        MOV     TEMP1,A         ;UPDATE TOTAL FOLD TIME
        CLR     PTOG            ;SET FOR LEFT SIDE BLAST
        LJMP    PSK             ;GO CHECK FOR CONVEYOR PAUSE
:
;CHECK IF WE NEED TO PAUSE CONVEYOR
; - PAUSE IF TOTAL FOLD TIME > DISTANCE LEADING EDGE TO END OF AIR BAR
; - IF WE PAUSE, CALCULATE TIME TILL RESTART
```

```
PSK:    NOP                         :CHECK IF WE NEED TO PAUSE CONVEYOR
        MOV     A,#240              :HOW FAR IS TOWEL LEADING EDGE TO END OF BAR?
        CLR     C
        SUBB    A,PLEN              :(72" - LENGTH OF TOWEL)
        JC      PSKE                :PAUSE IF TOWEL > 72"
        SUBB    A,TEMP1
        JC      PSKE                :PAUSE IF DISTANCE TO END < TOTAL FOLD TIME
        SJMP    PSKH
:
PSKE:   MOV     A,#255              :WE NEED TO PAUSE!
        CLR     C
        SUBB    A,PLOC              :DON'T PAUSE UNTIL PREVIOUS TOWEL > 5" PAST END
OF BAR
        JNZ     PSKF                :(77" - 72"), WATCH OUT FOR ZERO!
        MOV     A,#1
PSKF:   MOV     TTSTP,A             :LOAD DELAY UNTIL PAUSE!
:
        MOV     A,#240              :IF WE NEED TO PAUSE, CALCULATE TIME TO RESTART
        CLR     C
        SUBB    A,PLEN
        JNC     PSKG
        MOV     A,#0
PSKG:   MOV     TEMP2,A             :GET DISTANCE TO END OF BAR
        MOV     A,TEMP1             :GET TOTAL FOLD TIME
        CLR     C
        SUBB    A,TEMP2
        ADD     A,TTSTP             :DELAY TO START = TOTAL FOLD TIME - DISTANCE TO
END + DELAY TO STOP
        MOV     TTST,A
:
PSKH:   LJMP    PSM
:
:LENGTH DEPENDANT BLAST CALCULATION
:LENGTH OF AIR BLAST = AMIN + (L - LMIN)(AMAX - AMIN/LMAX-LMIN)
:AMIN = MINIMUM BLAST LENGTH
:AMAX = MAX "
:LMAX = MAXIMUM LENGTH TO FOLD
:LMIN = MINIMUM LENGTH TO FOLD
:L = MEASURED LENGTH
:
BLCALC: MOV     R1,#AMAX            :(AMAX - AMIN)(1 + 90/256) = X
        MOV     A,@R1               :(AMAX - AMIN)/190 = X/256
        CLR     C                   :WHERE 190 = LMAX - LMIN
        MOV     R1,#AMIN
        SUBB    A,@R1
        MOV     TEMP1,A
        MOV     B,#90
        MUL     AB
        MOV     A,B
        ADD     A,TEMP1
        MOV     B,A

        MOV     A,PLEN              :L - LMIN
        CLR     C
        SUBB    A,LMIN
```

```
:
        MUL     AB
        MOV     A.B
        ADD     A.@R1               :BLAST LENGTH
        RET
:
:WIDTH DEPENDANT BLAST CALCULATION
:LENGTH OF AIR BLAST = AMIN + (W - WMIN)(AMAX - AMIN/WMAX-WMIN)
:AMIN - MINIMUM BLAST LENGTH
:AMAX = MAX "
:WMAX = MAXIMUM WIDTH TO FOLD (0)
:WMIN = MINIMUM WIDTH TO FOLD (21)
:WIDTH = PRESET WIDTH
:
LCALC: MOV      R1.#AMAX            :(AMAX - AMIN)(12 + 49/256) = X
        MOV     A.@R1               :(AMAX - AMIN)/21 = X/256
        CLR     C                   :WHERE 21 = WMAX - WMIN
        MOV     R1.#AMIN
        SUBB    A.@R1
        MOV     TEMP1.A
        MOV     B.#12
        MUL     AB
        MOV     TEMP2.A
        MOV     TEMP2.B
        MOV     A.TEMP1
        MOV     B.#49
        MUL     AB
        MOV     A.B
        ADD     A.TEMP2
        MOV     B.A

        MOV     R1.#WIDTH           :W - WMIN
        MOV     A.@R1

        MUL     AB
        MOV     TEMP1.B
        MOV     A.@R1
        MOV     B.TEMP3
        MUL     AB
        ADD     A.TEMP1
        MOV     R1.#AMIN
        ADD     A.@R1               :BLAST LENGTH
        RET

DELAY TO FOLD START = LMAX - PLEN - TOTAL FOLD TIME
IF RESULT IS NEGATIVE. START FOLD IMMEDIATE (STOP CONVEYOR)
AND LOAD SETPOINT FOR CONVEYOR TO STOP

LCALC: MOV      A.LMAX
        CLR     C
        SUBB    A.#13               :CORRECTION!!
        CLR     C
        SUBB    A.TEMP1
        SUBB    A.PLEN
        JC      DLCLCA
        INC     A
        RET
```

```
;
DLCLCA:  CLR     PCV
         CPL     A
         JNZ     DLCLCB
         MOV     A,#1
DLCLCB:  ADD     A,#24
         MOV     TTST,A
         MOV     A,#1
         RET
;
;ADJUSTMENT FOR HALF BLAST LENGTH IS 125/100 OF FRENCH
;
ADHALF:  MOV     TEMP1,A
         MOV     B,#64
         MUL     AB
         MOV     A,B
         ADD     A,TEMP1
         RET
;
;AFTER SERVICE FOR TOWEL TYPE,
; - RESET ALL ACCUMULATORS AND FLAGS
; - CHECK FOR FOLD SERVICE
; - RESET DISTANCE COUNTER (PLOC)
;
PSM:     CLR     PCALCP
         MOV     INACCL,#0
         MOV     INACCR,#0
         MOV     INACCF,#0
         CLR     REJL
         CLR     REJO
         CLR     REJC
         CLR     INOVFL
         MOV     PLOC,#0
;
         RET
```

We claim:

1. A folding apparatus comprising conveyor means for moving foldable articles along a path of movement; opposed first and second air discharge means disposed adjacent the path of movement for discharging air in a variable sequence and folding opposed panel portions of such foldable articles over intermediate panel portions of such foldable articles; each of such foldable articles having a length no greater than the length of either of said air discharge means; means for measuring the size of each of such foldable articles moving on said conveyor means; and means for controlling the specific sequence of air discharge by said first and second air discharge means for each of such foldable articles responsive to such article size measuring means.

2. The folding apparatus of claim 1 in which the sequence of air discharge through said first and second air discharge means is reversed on consecutive foldable articles by the controlling means when the article size measuring means measures sizes of such consecutive articles able to be folded while simultaneously moving between said first and second air discharge means on said conveyor means.

3. The folding apparatus of claim 1 in combination with means for stopping said conveyor means responsive to said measuring means; the stopping means stopping said conveyor means when a foldable article which is measured is unable to be completely folded while moving between said first and second air discharge means on said conveyor means.

4. The folding apparatus of claim 3 in which the sequence controlling means maintains a predetermined sequence of discharge through said first and second air discharge means in the course of folding a foldable article which has the folding thereof completed with the conveyor means in the stopped condition.

5. The folding apparatus of claim 4 in which the pressure of the air discharged through the second air discharge means in effecting the second fold with the conveyor in the stopped condition is greater than the pressure of the air discharged through said first air discharge means.

6. The folding apparatus of claims 4 or 5 in which the angle of the air discharged through the second air discharge means is upwardly inclined to the horizontal.

7. The folding apparatus of claim 6 in which air discharge through the first air discharge means is substantially horizontal and the air discharge through the second air discharge means is inclined at an angle of about 15 degrees.

8. A folding apparatus as recited in claim 1 wherein each said air discharge means is formed with separate compartments and said controlling means includes means for controlling air discharge from said compartments as a function of the length of the foldable article and the location of the foldable article along the path of movement at a predetermined time.

9. A folding apparatus comprising conveyor means for moving foldable articles along a path of movement; first and second air discharge means disposed adjacent the path of movement for discharging air in sequence over a portion of the moving conveyor means; said air discharge means defining a folding field over said conveyor means for folding opposed first and second portions of each of such foldable articles over an intermediate portion of each such foldable article on said conveyor means; such foldable articles having a length not greater than that of said folding field; means for measuring the size of each foldable article conveyed on said conveyor means and entering said folding field; means for controlling the folding of the opposed first and second portions of each such foldable article, said means for controlling being responsive to said measuring means for calculating the distance of travel of each such foldable article moving at the speed of said conveyor means; and means for stopping said conveyor means with the leading edge of such foldable article thereon at the end of said folding field when the combined length of such foldable article and its fold-completing distance of travel amounts to a length sum which exceeds the length of said folding field, said stopping means being responsive to said controlling means.

10. A folding apparatus comprising conveyor means for moving foldable articles along a path of movement; first and second air discharge means disposed adjacent the path of movement for discharging air in sequence and folding opposed first and second panel portions of such foldable article over an intermediate panel portion of such foldable article as such article is moving on said conveyor means between said first and second air discharge means; and means for controlling the discharge of air through said first and second consecutive articles as at least portions of such consecutive articles simultaneously move between said first and second air discharge means.

11. The folding apparatus of claim 9 in which said conveyor means is stopped by the stopping means for a time period equal to the length of time for the conveyor means to travel the distance by which the length sum exceeds the length of the folding field.

12. The folding apparatus of claims 1, 8 or 10 in which the foldable articles are towels having widths corresponding with the lengths measured by the measuring means and the length of the air discharges are controlled by said controlling means so as to be in proportion to the article widths.

13. The folding apparatus of claims 1, 9 or 10 in combination with edge-defining means disposed in the folding field between said first and second air discharge means; the air discharge means sequentially folding panel portions of a foldable article about said edge-defining means and forming French folds in such foldable articles.

14. The folding apparatus of claim 13 in which said conveyor means has a central portion disposed beneath said edge-defining means and opposed lateral portions disposed above said edge-defining means; the air discharge means discharging air between the conveyor central portion and the conveyor lateral portions.

15. The method of claim 14 in which the conveyor is stopped with the leading edge of the article at the end of the folding field.

16. The folding apparatus of claim 13 in combination with a stop surface disposed over said edge-defining means over which foldable article panel portions driven by said air discharge means over said edge-defining means slidably move.

17. The folding apparatus of claim 10 in which the discharge-controlling means prevents discharge of air through the air discharge means for folding the second panel portion of such second consecutive article until the first consecutive article moves beyond the ends of such air discharge means.

18. The folding apparatus of claims 10 or 17 in combination with article measuring means for measuring the length of each of such consecutive articles and the interval therebetween; said discharge-controlling means being responsive to such measurements and delaying the discharge of air through the air discharge means for folding the second panel portion of the second consecutive article for a time of conveyor travel for traveling a distance equal to the distance for the first consecutive article to completely pass beyond the ends of the air discharge means less the distance the second consecutive article must travel on said conveyor means before the second panel portion thereof is folded by an air discharge.

19. A method for forming French folds in foldable articles by means of opposed air discharge means which operate in sequence to fold opposed first and second panels of a foldable article over an intermediate panel portion and defining a folding field through which foldable articles are conveyed; portions of a first and second foldable article being simultaneously within such folding field; the steps comprising measuring the size of the first article entering the folding field; folding a first and second panel of the first article by first and second sequential air discharges of the opposed air discharge means; measuring the size of the second article entering the folding field and the distance the second article must travel in the field until the second air discharge occurs on said second article; calculating the distance the first article travels to exit the folding field when the second article is completely measured; and folding a first panel of the second article by the air discharge means which folded the second panel of the first foldable article.

20. The method of claim 19 in which the second air discharge to fold the second panel of the second article is delayed until the first article has left the folding field.

21. The method of claim 20 in which the second air discharge to fold the second panel of the second article is delayed for the time the second article must travel in the folding field until the second air discharge occurs less the time of travel of the distance by the first article to exit the folding field when the second article is completely measured.

22. In a method for forming folds in foldable articles by means of opposed air discharge means which operate in sequence to fold opposed first and second panel portions of a foldable article over an intermediate panel portion; said discharge means defining a folding field through which foldable articles are conveyed by a conveyor at a speed which prevents sequential folding of the opposed panels of a foldable article within the folding field without stopping of the conveyor; such articles having a length no greater than that of the folding field; the steps comprising measuring the size of a foldable article entering the folding field and the time for such article to enter the folding field on the conveyor; calculating the distance the article must travel in the folding field on the conveyor to complete the folding of the panel portions; and stopping the conveyor travel with the article in the folding field for the sum of the time of article travel in the folding field to complete the folding of the panel portions plus the time of article travel in entering the folding field, less the time of article travel on the conveyor to pass through the entire folding field.

* * * * *